US006879801B2

(12) United States Patent
Soda et al.

(10) Patent No.: US 6,879,801 B2
(45) Date of Patent: Apr. 12, 2005

(54) IMAGE FORMING APPARATUS

(75) Inventors: Takamitsu Soda, Shizuoka (JP); Naoki Enomoto, Shizuoka (JP); Takao Kume, Shizuoka (JP); Koichi Suzuki, Shizuoka (JP); Noriaki Sato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/372,308

(22) Filed: Feb. 25, 2003

(65) Prior Publication Data

US 2003/0219286 A1 Nov. 27, 2003

(30) Foreign Application Priority Data

Feb. 28, 2002 (JP) ..... 2002-054469
May 8, 2002 (JP) ..... 2002-133069
Jul. 31, 2002 (JP) ..... 2002-223950

(51) Int. Cl.[7] ..... G03G 15/01

(52) U.S. Cl. ..... 399/302; 399/99; 399/100; 399/101

(58) Field of Search ..... 399/101, 99, 297, 399/298, 301, 302, 100

(56) References Cited

U.S. PATENT DOCUMENTS 5,307,127 A 4/1994 Kobayashi et al. ..... 355/259
5,376,998 A 12/1994 Suzuki ..... 355/326
5,548,381 A 8/1996 Saito et al. ..... 355/245
5,678,130 A 10/1997 Enomoto et al. ..... 399/55
5,732,310 A 3/1998 Hiroshima et al. ..... 399/101
5,809,387 A 9/1998 Takeuchi et al. ..... 399/302
5,873,010 A 2/1999 Enomoto et al. ..... 399/39
6,091,913 A 7/2000 Suzuki et al. ..... 399/49
6,175,702 B1 * 1/2001 Takeuchi et al. ..... 399/101
6,477,344 B1 * 11/2002 Asakura et al. ..... 399/101
6,615,015 B2 * 9/2003 Nakazawa et al. ..... 399/302
2002/0051142 A1 5/2002 Ogata et al. ..... 358/1.8

FOREIGN PATENT DOCUMENTS

JP 10-49019 2/1998
JP 10-133489 5/1998
JP 11-161043 6/1999

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes a first image bearing member and a second shiftable image bearing member. A first transferring member transfers a toner image formed on the first image bearing member to the second image bearing member at a first region. A second transferring member transfers a toner image formed on the second image bearing member to a transferring material at a second region. A first electrifier is provided downstream of the second region and upstream of the first region in a shifting direction of the second image bearing member. A second electrifier is provided downstream of the second region and upstream of the first electrifier in the shifting direction. A voltage applying unit applies a voltage to the first and second electrifiers to transfer toner adhered to the first and second electrifiers onto the second image bearing member.

39 Claims, 26 Drawing Sheets

REMOVAL PROCESS OF ADHERING TONER

PRIOR ART OF REMOVAL PROCESS OF ADHERING TONER

IMAGE FORMING APPARATUS

BACKGROUND OF THE INVENTION

1. Field of the Invention

The present invention relates to an image forming apparatus such as a copying machine, a printer and the like, and more particularly, it relates to an image forming apparatus having an intermediate transferring member and electrifying (charging) means for electrifying developer remaining on the intermediate transferring member after secondary transferring.

2. Related Background Art

FIG. 10 shows an example of a conventional color image forming apparatus of intermediate transferring belt type using an intermediate transferring belt as an intermediate transferring member. A photosensitive drum 1 as an electrostatic latent image bearing member is constituted by applying organic photoconductor (OPC) or photoconductor formed from A—Si, CdS or Se onto an outer peripheral surface of a metal core, which drum forms a first image bearing member.

In an exposure position 3*a* on a surface of the photosensitive drum 1, a latent image is formed by an exposing apparatus 3. A contact portion between the photosensitive drum 1 and an intermediate transferring belt 6*a* defines a position (primary transferring portion) T1 for performing primary transferring. A distance from the exposure position 3*a* of the photosensitive drum 1 to the primary transferring portion T1 in a counter-clockwise direction in FIG. 10 is defined as a distance L1, and a position spaced apart, by L1, from the primary transferring portion T1 on the intermediate transferring belt 6*a* in an upstream direction is defined as an S portion.

The intermediate transferring belt 6*a* as a second image bearing member is formed from rubber such as EPDM, NBR, urethane or silicone rubber, or resin such as PI, PC, PVDF, ETFE, PET, PC/PAT, ETFE/PC, ETFE/PAT or PC/PAT and is mounted, in tension, around three rollers, i.e., a drive roller 6*b*, a tension roller 6*c* and a secondary transferring counter roller 6*d* so that the belt is driven in a driven direction shown by the arrow C3 with respect to the photosensitive drum 1 rotating in a direction C1 by rotating the drive roller 6*b* by means of a motor (not shown).

Further, a primary transferring roller 7*b* constituted by a shaft and a conductive sponge layer thereon is contacted with the photosensitive drum 1 with the interposition of the intermediate transferring belt 6*a* in the primary transferring portion T1.

Further, at one circumferential portion of the intermediate transferring belt 6*a*, i.e., at an end transverse to a circumferential direction, that is, an end of the belt 6*a*, there is provided a position detecting member 5*a* which can be distinguished from the surface of the intermediate transferring belt 6*a* by means of an optical sensor 5, so that a timing when the position detecting member 5*a* passes through a detecting portion 5*b* due to rotation of the intermediate transferring belt 6*a* is detected by the optical sensor (referred to as "TOP detection" hereinafter) and a rotating condition of the intermediate transferring belt 6*a* can be recognized by counting a time from the detecting timing within a main body of the apparatus.

Alternating voltage obtained by overlapping alternating voltage with DC voltage from an alternating voltage power supply 10*a* is applied to an electrifying roller 10*b* provided around the intermediate transferring belt 6*a* and disposed between a position (secondary transferring portion) T2 for performing the secondary transferring and the primary transferring portion T1. Incidentally, the electrifying roller 10*b* has an abutment/separation mechanism (not shown) with respect to the intermediate transferring belt 6*a* and can abut against the belt at a desired timing. Further, a counter electrode 10*c* for grounding to enhance electrifying efficiency is provided on a back surface of a portion of the intermediate transferring belt 6*a* against which the electrifying roller 10*b* abuts.

Now, an image forming operation will be described with reference to FIG. 10.

The photosensitive drum 1 and the intermediate transferring belt 6*a* are rotated in normal directions shown by the arrows C1 and C3, respectively, at the same speed (referred to as "process speed" hereinafter) V of 118.0 mm/s. The photosensitive drum 1 having a circumferential length of 147.5 mm is rotated by one revolution at 147.5/V=1.25 s and the intermediate belt 6*a* having a circumferential length of 442.5 mm is rotated by one revolution at 442.5/V=3.75 s.

The photosensitive drum 1 is driven in the direction C1 by drive means (not shown) and is uniformly electrified with predetermined potential by an electrifying roller 2. When the TOP detection of the rotating intermediate transferring belt 6*a* is performed by the optical sensor 5, the exposure is started by the exposing apparatus 3, with the result that a light signal corresponding to a yellow pattern is scanned on the uniformly electrified photosensitive drum 1, thereby forming a latent image.

After the latent image formation is started, when the photosensitive drum 1 is further rotated in the direction C1, a support 4 is rotated in a direction shown by the arrow C2 so that a developing apparatus 4*a* containing yellow toner among developing apparatuses 4*a*, 4*b*, 4*c* and 4*d* supported by the support 4 is opposed to the photosensitive drum 1, with the result that latent image formed on the photosensitive drum 1 is visualized by the selected developing apparatus 4*a* to form a developer image (toner image). Here, upon the development, the toner has negative polarity.

When the photosensitive drum 1 is further rotated in the direction C1 to reach the primary transferring portion T1, the developed toner image is primarily transferred onto the intermediate transferring belt 6*a* by applying primary transferring bias having positive polarity opposed to the negative polarity toner upon the development from a high voltage power supply 7*a* to the primary transferring roller 7*b*, using the metal core of the photosensitive drum 1 as a counter electrode.

After the transferring, residual toner remaining on the photosensitive drum 1 is cleaned or removed by a cleaner 13.

After a time (L1/V) is elapsed from the start of the exposure, a point on the photosensitive drum 1 from where the writing of an image is started and a point 6S on the intermediate transferring belt 6*a* which has passed through the S portion upon initiation of the exposure coincide with each other at the position T1. That is to say, the image is formed from its leading end on the intermediate transferring belt 6*a* in a counter-clockwise direction.

When the development of the yellow toner image is finished, the developing apparatus is switched to a new developing apparatus. In a printing sequence according to the present invention, by using a timing design for forming an A4 image, i.e. an image of 297 mm, the sequence can be utilized with respect to all sizes smaller than A4, thereby making the process in common. (Hereinafter, an A4 mode will be explained.) When a time (297 mm/V) is elapsed after the leading edge of the image reached the developing portion, the support 4 is rotated in the counter-clockwise direction, with the result that the developing apparatus 4*b* containing magenta toner is positioned to be opposed to the photosensitive drum 1.

Further, when the next TOP detection is performed, similar operations are repeated, so that the developing and transferring operations are performed with respect to a magenta color, a cyan color and a black color, with the result that plural color toner images are formed on the intermediate transferring belt 6*a* in a superimposed fashion.

In this case, since all of four color images are transferred so that the leading edge of each image coincides with the point 6S, the four color toner images are registered with each other.

When the four color toner images are transferred to the intermediate transferring belt 6*a* in the superimposed fashion, a transferring material P is conveyed from a registration roller pair R in synchronism with the movement of the intermediate transferring belt 6*a* and a secondary transferring roller 9 having the similar construction to that of the primary transferring roller 7*b* abuts against the intermediate transferring belt 6*b* with the interposition of the transferring material P at the secondary transferring portion T2, and, by applying secondary transferring bias having positive polarity from a high voltage power supply (not shown) by utilizing the secondary transferring counter roller 6*d* supporting the intermediate transferring belt 6*a* as a counter electrode, the four color toner images on the intermediate transferring belt 6*a* are secondarily transferred onto the transferring material P collectively.

The transferring material P to which the four color toner images were transferred is sent to a conventional fixing apparatus 11 of heat and pressure type, where the toner images are fused and fixed, thereby forming a color image.

Now, electrifying and recovering of secondary transferring residual developer (secondary transferring residual toner) remaining on the intermediate transferring belt after the secondary transferring will be explained with reference to FIG. 11 on the basis of a normal page interval process or step. Incidentally, in FIG. 11, developments for first to fourth colors are designated by Dv1 to Dv4, primary transferring operations for first to fourth colors are designated by Tr1 to Tr4, secondary transferring is designated by Tr2, electrifying (charging) of the secondary transferring residual toner is designated by Ch2, and recovering of such residual toner at the primary transferring portion T1 is designated by RET.

Charges of positive polarity are uniformly applied to the secondary transferring residual toner not transferred to the transfer material P and remaining on the intermediate transferring belt 6*a* after the secondary transferring to the transferring material P by an electrifying roller 10*b* to which alternating voltage of positive polarity obtained by overlapping alternating voltage with DC voltage is applied from an alternating voltage power supply 10*a*.

Then, the secondary transferring residual toner electrified with positive polarity by the electrifying roller 10*b* reaches the primary transferring portion T1 due to the rotation of the intermediate transferring belt 6*a* and is removed from the intermediate transferring belt 6*a* by electrostatically transferring the toner to the photosensitive drum 1 at the same time as primary transferring of a first color of a next page.

The secondary transferring residual toner transferred to the photosensitive drum 1 is recovered into a photosensitive drum cleaner 13. In this way, removal of the secondary transferring residual toner on the intermediate transferring belt 6*a* is completed.

Incidentally, various operations, i.e. the printing sequence for forming the image includes at least two processes, i.e. a continuous image forming process for performing the above-mentioned image formation continuously, and a process effected after the continuous image forming process, for cleaning the second image bearing member to remove the secondary transferring residual toner in the last image formation in the continuous image forming process, toner naturally (mechanically without voltage) discharged from the secondary transferring residual toner electrifying roller 10*b* and toner flying within the apparatus.

On the other hand, whenever the image formation is performed, since adhering (or sticking) developer (adhering (or sticking) toner) having negative polarity which was not electrified when the secondary transferring residual toner is electrified with positive polarity is adhered to the electrifying roller 10*b*, if images are formed continuously through plural pages, the adhering toner will be accumulated.

Further, since the adhering toner gradually worsens electrifying performance of the electrifying roller 10*b* to cause poor cleaning of the intermediate transferring belt 6*a* due to poor electrifying, it is necessary to effect the cleaning for removing the adhering toner on the electrifying roller 10*b*.

In the past, a process for removing the toner adhered to the electrifying roller 10*b* was performed in the post-rotation process of the printing sequence. Now, an example of such a process will be described.

The removal of the adhering toner is performed by discharging the adhering toner from the electrifying roller 10*b* onto the intermediate transferring belt 6*a* by applying bias having negative polarity to the electrifying roller 10*b*. When the discharged toner reaches the primary transferring portion T1, the bias to be applied to the primary transferring roller 7*b* is switched to negative polarity, thereby transferring the toner onto the photosensitive drum 1 by an electrostatic repelling force. Lastly, the toner is recovered by the photosensitive drum cleaner 13. In this way, the removal is completed. Timings of such operations will be explained with reference to FIG. 12.

After the secondary transferring in the image formation of the last page among a predetermined number of pages (page number) in the continuous image forming process is finished, the post-rotation process is started. In the post-rotation process, the secondary transferring residual toner (of the plural color toner images) remaining on the intermediate transferring belt 6*a* after the secondary transferring regarding the last page in the continuous image forming process is electrified with positive polarity and is recovered at the primary transferring portion T1. Further, the excessive toner adhered to the second image bearing member such as the toner naturally (mechanically without voltage) discharged from the secondary transferring residual toner electrifying roller 10*b* and the toner flying within the apparatus is also recovered at the primary transferring portion T1 simultaneously.

In the post-rotation process, the bias to be applied to the primary transferring roller 7*b* at any timing is switched to negative polarity so that the recovering of the toner having negative polarity and discharged from the electrifying roller 10*b* onto the intermediate transferring belt 6*a* is permitted.

Further, in coincidence with the timing for applying the negative polarity bias, the bias being applied from the alternating voltage power supply 10*a* to the electrifying roller 10*b* is switched to alternating voltage having negative polarity, thereby starting the discharging of the adhering toner.

That is to say, at the timing for switching the bias to be applied to the electrifying roller 10*b* to the negative polarity, when the portion of the intermediate transferring belt 6*a* which has passed through the electrifying roller 10*b* reaches the primary transferring portion T1, the bias to be applied to the primary transferring roller 7*b* is also switched to the negative polarity. After the adhering toner is discharged for a predetermined time and is recovered at the primary transferring portion T1, the bias being applied to the electrifying roller 10*b* is turned OFF, and, when the portion passed through the electrifying roller 10*b* at that time reaches the primary transferring portion T1, the bias to be applied to the primary transferring roller 7*b* is also turned OFF. Such operations are the post-rotation process.

By doing so, the discharged toner is electrostatically transferred onto the photosensitive drum 1 and thus is removed from the intermediate transferring belt 6*a*. The discharged toner transferred to the photosensitive drum 1 is recovered by the photosensitive drum cleaner 13. In this way, the removal of the toner adhered to the electrifying roller 10*b* is completed.

However, if the images for a large number of pages are formed in one printing sequence, the toner adhered to the electrifying means is accumulated excessively and be dropped to contaminate the interior of the apparatus and/or the transferring material and, in the removal process for removing the adhering toner, the adhering toner transferred to the intermediate transferring belt may not be recovered by the photosensitive drum adequately to contaminate the intermediate transferring belt and/or to cause poor image.

Such inconveniences are easily generated particularly when a printing ratio of the image in which the secondary transferring residual toner increased is high and, under high temperature/high humidity and low temperature/low humidity environments where the secondary transferring ability is worsened.

SUMMARY OF THE INVENTION

An object of the present invention is to provide an image forming apparatus which can prevent toner from adhering to an electrifying member for electrifying toner remaining on an image bearing member, thereby preventing deterioration of electrifying performance.

Another object of the present invention is to provide an image forming apparatus comprising a first image bearing member, a second shiftable image bearing member, first transferring means for transferring a toner image on the first image bearing member to the second image bearing member at a first transferring portion, second transferring means for transferring the toner image on the second image bearing member to a transferring material at a second transferring portion, a first electrifying member provided at a downstream side of the second transferring portion and at an upstream side of the first transferring portion in a shifting direction of the second image bearing member, a second electrifying member provided at a downstream side of the second transferring portion and at an upstream side of the first electrifying member in the shifting direction of the second image bearing member, and voltage applying means for applying voltage to the first and second electrifying members, and wherein the voltage applying means apply the voltage to the first and second electrifying members to transfer toner adhered to the first and second electrifying members onto the second image bearing member.

A further object of the present invention is to provide an image forming apparatus comprising a first image bearing member, a second shiftable image bearing member, first transferring means for transferring a toner image on the first image bearing member to the second image bearing member at a first transferring portion, second transferring means for transferring the toner image on the second image bearing member to a transferring material at a second transferring portion, a first electrifying member provided at a downstream side of the second transferring portion and at an upstream side of the first transferring portion in a shifting direction of the second image bearing member, a second electrifying member provided at a downstream side of the second transferring portion and at an upstream side of the first electrifying member in the shifting direction of the second image bearing member, and voltage applying means for applying voltage to the first and second electrifying members, and wherein the voltage applying means apply the voltage to the second electrifying member to transfer toner adhered to the second electrifying member onto the second image bearing member.

A still further object of the present invention is to provide an image forming apparatus comprising a first image bearing member, a second shiftable image bearing member, first transferring means for transferring a toner image on the first image bearing member to the second image bearing member at a first transferring portion, second transferring means for transferring the toner image on the second image bearing member to a transferring material at a second transferring portion, a first electrifying member provided at a downstream side of the second transferring portion and at an upstream side of the first transferring portion in a shifting direction of the second image bearing member, a second electrifying member provided at a downstream side of the second transferring portion and at an upstream side of the first electrifying member in the shifting direction of the second image bearing member, and voltage applying means for applying voltage to the first and second electrifying members, and wherein the voltage applying means apply the voltage to the first electrifying member to transfer toner adhered to the first electrifying member onto the second image bearing member.

The other objects of the present invention will be apparent from the following detailed explanation.

DESCRIPTION OF THE PREFERRED EMBODIMENTS

An image forming apparatus according to the present invention will now be explained in more detail with reference to the accompanying drawings.

Figure 1:
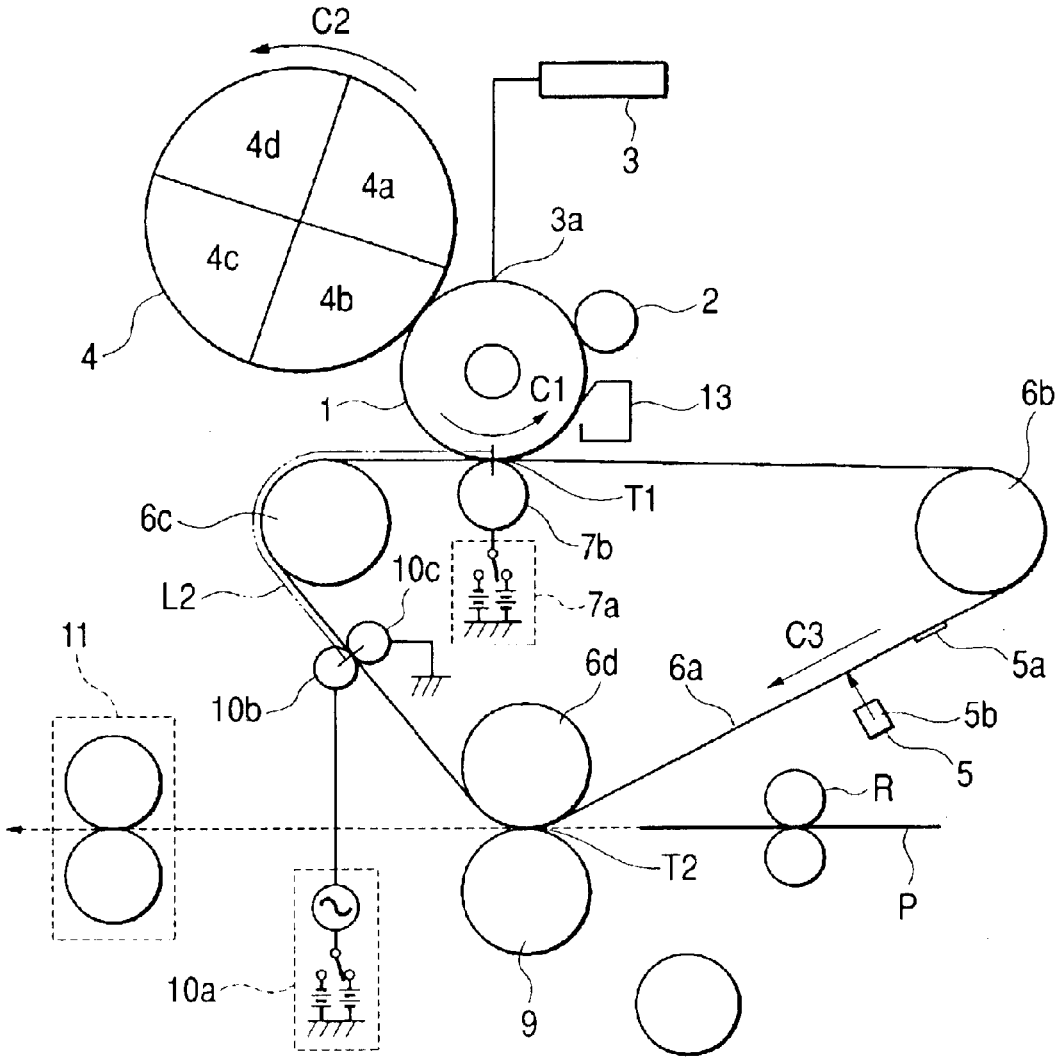
FIG. 1 is a view showing an image forming apparatus as a reference example of the present invention.

FIG. 1 shows a color image forming apparatus (for example, a copying machine or a laser beam printer) utilizing an electro-photographic process as an example of an image forming apparatus according to the present invention.

Regarding a fundamental construction other than a cleaning mechanism for an electrifying roller 10*b* as electrifying means for electrifying secondary transferring residual developer remaining on an intermediate transferring belt as a second image bearing member, since the image forming apparatus according to the reference example 1 is the same as the image forming apparatus explained in connection with FIG. 10, the similar members or elements are designated by the same reference numerals and explanation thereof will be omitted. In FIG. 1, it is assumed that a distance from the position of the electrifying roller 10*b* on the intermediate transferring belt 6*a* to the primary transferring portion T1 is L2. The symbols shown by the other members are the same as those in FIG. 10.

In the electrifying roller 10*b*, a disadvantage that the adhering toner of the secondary transferring residual toner is accumulated excessively and such toner is flying within the apparatus occurred.

Thus, in this reference example, in the continuous image forming process, for example, after the image formation for the predetermined sheet number (page) is finished and before the image formation for the next page is started, the cleaning is performed between the page which is subjected to the continuous image forming step and the next page, i.e. in a page interval.

As a method for cleaning the electrifying roller 10*b*, similar to the post-rotation process in the conventional example, discharging and recovering of the adhering toner are performed for a predetermined time.

Figure 2:
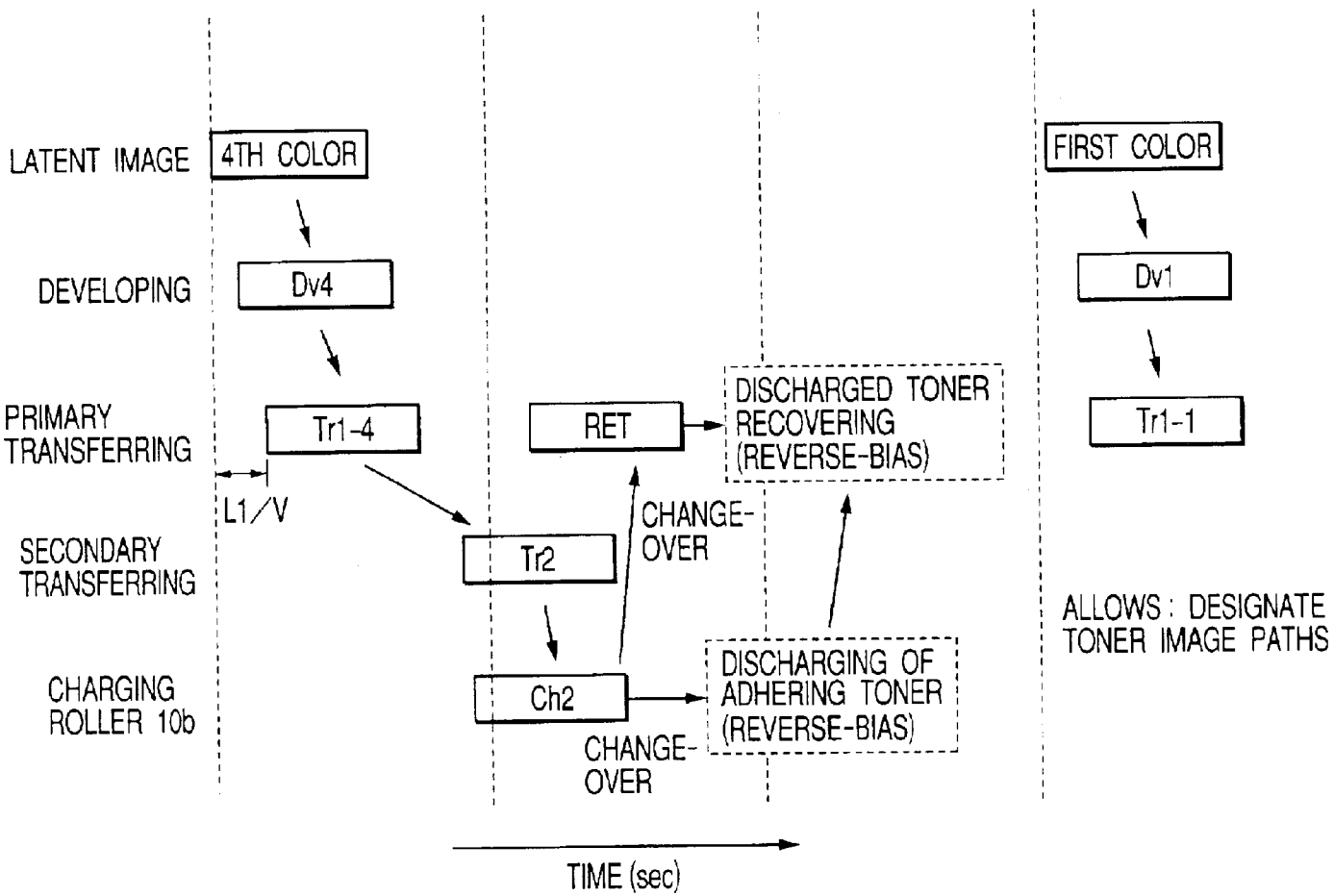
FIG. 2 is a timing chart showing a process for removing adhering toner from an electrifying roller in the apparatus of FIG. 1.

FIG. 2 is a view showing timings for applying various biases, as an example of a process for performing the cleaning of the electrifying roller 10*b* in the page interval (hereinafter, this process is called as "removal process of adhering toner" in order to distinguish this process from a normal page interval process in which the cleaning of the electrifying roller 10*b* is not performed), in the reference example.

Incidentally, the normal page interval process is the same as the page interval process in the conventional example. Although the removal process of adhering toner is performed in the page interval, the page interval may be one page or plural pages. Now, the removal process of adhering toner will be explained with reference to FIGS. 1 and 2.

In the continuous image forming process, after the image formations for the predetermined page number are performed, before the image formation for the next page is started, the discharging of the adhering toner from the electrifying roller 10*b* and the recovering of the toner onto the photosensitive drum 1 at the primary transferring portion T1 are performed for a predetermined time.

That is to say, when the portion of the intermediate transferring belt 6*a* which has passed through the electrifying roller 10*b* at the timing for switching the bias to be applied to the electrifying roller 10*b* to the negative polarity reaches the primary transferring portion T1, the bias to be applied to the primary transferring roller 7*b* is also switched to the negative polarity. The adhering toner is discharged for a predetermined time and is recovered at the primary transferring portion T1.

Further, in order to form the next page image, the bias being applied to the electrifying roller 10*b* is switched to alternating voltage having positive polarity, and, when the portion which has passed through the electrifying roller 10*b* at that time reaches the primary transferring portion T1, the bias to be applied to the primary transferring roller 7*b* is also switched to the positive polarity.

At this point, since the primary transferring of the next image is permitted, then, the formation of the next image is performed from when the TOP is detected so that the continuous image forming process is continued. When all image forming operations are finished, the post-rotation process is performed, and the printing sequence is finished.

More specifically, in an image forming apparatus in which the process speed V is 118.0 mm/s and L2 is 94.4 mm, within a predetermined time range after the recovering of the secondary transferring residual toner is finished, the recovering of the toner onto the photosensitive drum 1 is made possible by applying bias having negative polarity to the primary transferring roller 7*b*, and, correspondingly, within a time range before L2/V=0.800 s, the discharging is performed by applying bias having negative polarity to the electrifying roller 10*b*. Thereafter, the biases to be applied to the primary transferring roller 7*b* and the electrifying roller 10*b* are switched to the positive polarity, thereby forming the next image.

The above-mentioned removal process of adhering toner is performed, for example, for every 20 pages during the continuous image forming process and in the post-rotation process in each printing sequence so that the adhering toner is not accumulated on the electrifying roller 10*b* excessively thereby to avoid the poor image. It should be noted that the concrete numerical values listed here can be selected appropriately.

As mentioned above, since the cleaning of the electrifying roller can be performed not only in the post-rotation process but also in the page interval during the continuous image formation, the adhering toner is not accumulated on the electrifying roller excessively, and, accordingly, since the scattering of the accumulated toner and the contamination of the members thereby can be avoided and the electrifying roller can also be cleaned automatically during the continuous image formation, the poor image is not produced and operability can be enhanced.

Figure 3:
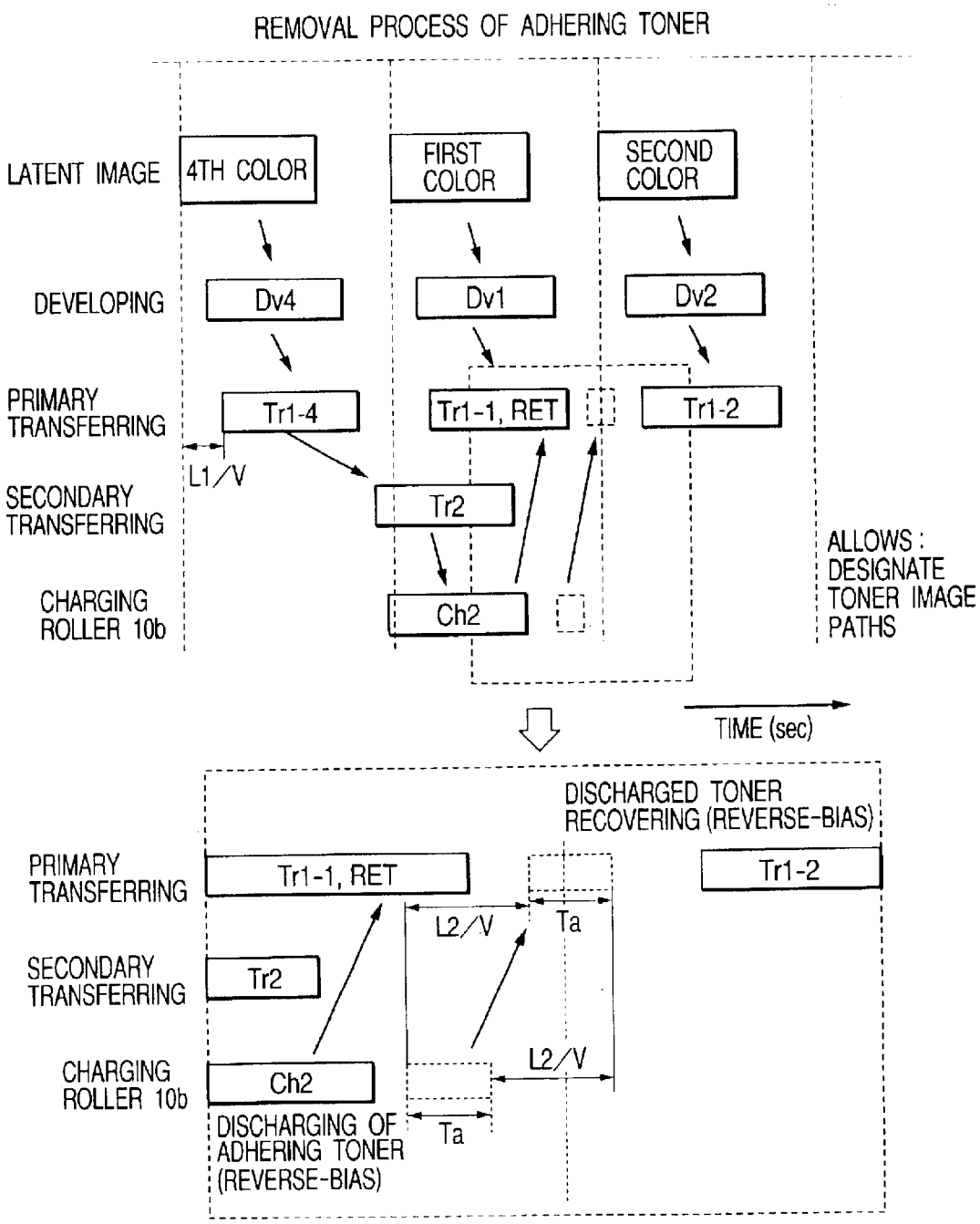
FIG. 3 is a timing chart showing a process for removing adhering toner from an electrifying roller in the apparatus of FIG. 1.

Next, another reference example 2 of the present invention will be explained. Also in this reference example, an image forming apparatus having the construction shown in FIG. 1 and similar to the reference example 1 can be used. FIG. 3 is a view showing applying timings for various biases, as an example of the removal process of adhering toner explained in connection with the reference example 1, in the reference example 2. Incidentally, the normal page interval process in which the removal of the adhering toner is not performed is similar to the page interval process in the conventional example.

Here, Ta indicates timings for applying bias for discharging the toner from the electrifying roller 10*b* and bias for recovering the toner onto the photosensitive drum 1.

Also in this reference example, although the removal of the adhering toner on the electrifying roller 10*b* is performed during the continuous image forming process, the timing for performing the removal of the adhering toner is effected at timing described hereinafter different from that in the reference example 1. The timings will now be explained with reference to FIG. 3.

In this reference example, the applying of the negative polarity bias at the electrifying roller 10*b* and the primary transferring roller 7*b* in order to discharge the adhering toner accumulated on the electrifying roller 10*b* and to recover the toner onto the photosensitive drum 1, i.e. the removal of the adhering toner is performed between the end of the primary transferring for the first color and the start of the primary transferring for the second color.

Incidentally, in this case, it is preferred that a time for performing the recovering is set in consideration of a time period during when the bias to be applied to the primary transferring roller 7*b* is switched from the bias for primarily transferring the first color image to the negative polarity bias for recovering the adhering toner from the intermediate transferring belt 6*a*. Further, within such a recoverable time range, the discharging is performed by applying the negative polarity bias to the electrifying roller 10*b* in a time range ahead (by L2/V) of a time range during which the negative polarity bias is applied to the primary transferring roller 7*b* so that the discharged toner enters into the primary transferring portion T1.

While the continuous image forming process is being continued, the above-mentioned process is performed for every predetermined page number. When all image formations are finished, the post-rotation process is performed, and the printing sequence is completed.

This reference example provides an effect that, by executing the timing for removing the adhering toner at the above-mentioned timing different from that in the reference example 1, the number of revolutions of the intermediate transferring member 6*a* as the second image bearing member for forming one image can always be kept constant and the printing speed is not reduced even when the operation for removing the adhering toner is performed.

More specifically, in an A4 mode printing sequence of an image forming apparatus in which a length L6 of the intermediate transferring belt is 442.5 mm and process speed V is 118.0 mm and L2 is 94.4 mm, within a time duration from when the primary transferring bias having positive polarity is applied by an amount corresponding to 297 mm from the image leading end regarding the primary transferring for the first color (simultaneously, recovering of the secondary transferring residual toner) to when the primary transferring for the second color is started, i.e. within a predetermined time range of (L6−297)/V=1.233 s, the bias having negative polarity is applied to the primary transferring roller 7*b* to permit the recovering of the toner onto the photosensitive drum 1, and, further, the discharging is performed by applying the bias having negative polarity to the electrifying roller 10*b* within a time range ahead of it by L2/V=0.800 s.

The above-mentioned removal process of adhering toner is performed, for example, for every 20 pages in the continuous image forming process in each printing sequence and in the post-rotation process so that the adhering toner is not accumulated on the electrifying roller excessively to avoid the inconvenience such as the poor image.

As mentioned above, since the number of revolutions of the intermediate transferring member 6*a* can always be kept constant by performing the cleaning of the electrifying roller between the first color and the second color during one image formation in the continuous image forming process, the printing speed is not reduced and the operability is further enhanced, as well as the effect of the reference example 1 that the adhering toner is not accumulated on the electrifying roller excessively.

Figure 4:
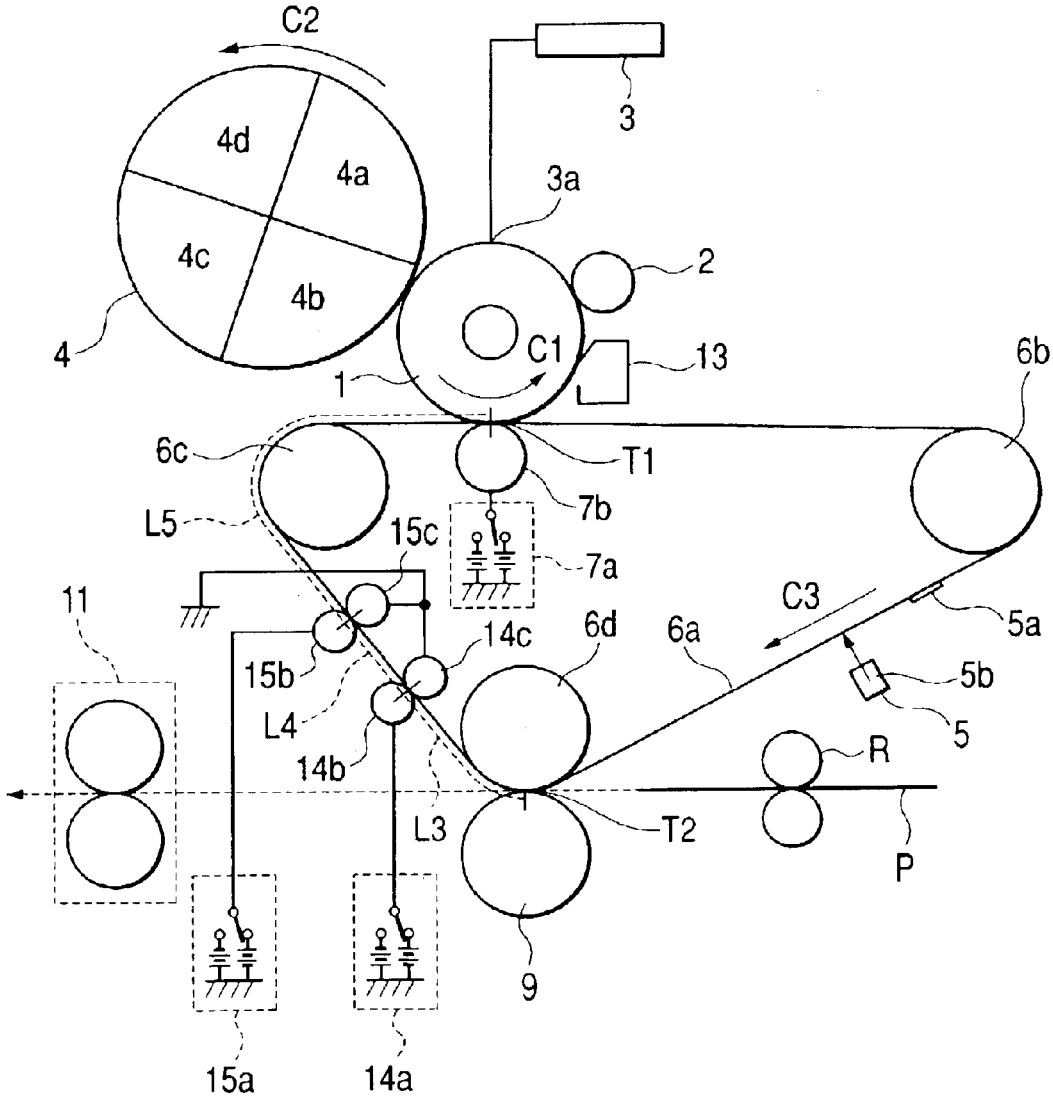
FIG. 4 is a view showing an image forming apparatus according to an embodiment of the present invention.

Next, an embodiment 1 of the present invention will be explained. FIG. 4 is a view showing a color image forming apparatus utilizing an electro-photographic process, as an example of an image forming apparatus according to the present invention. In this embodiment, as electrifying rollers for electrifying the secondary transferring residual toner (shown as the electrifying roller 10*b* in the above examples), an electrifying roller 15*b* as a first electrifying member and an electrifying roller 14*b* as a second electrifying member are provided on the intermediate transferring belt 6*a*.

DC voltages are applied to the electrifying rollers 14*b* and 15*b* by DC voltage power supplies 14*a* and 15*a*, respectively, and each roller has an abutment/separation mechanism with respect to the intermediate transferring belt 6*a* so that the roller can abut against the belt at any time. In order to increase electrifying efficiencies of the electrifying rollers 14*b* and 15*b*, there are provided grounding counter electrodes 14*c* and 15*c* opposed to the electrifying rollers 14*b* and 15*b* with the interposition of the intermediate transferring belt 6*a*. Here, the electrifying roller 14*b* is disposed at an upstream side of the electrifying roller 15*b* in a shifting direction of the intermediate transferring belt 6*a*. Namely, a portion of the intermediate transferring belt 6*a* which has passed through the secondary transferring portion firstly reaches the electrifying roller 14*b*.

Figure 5:
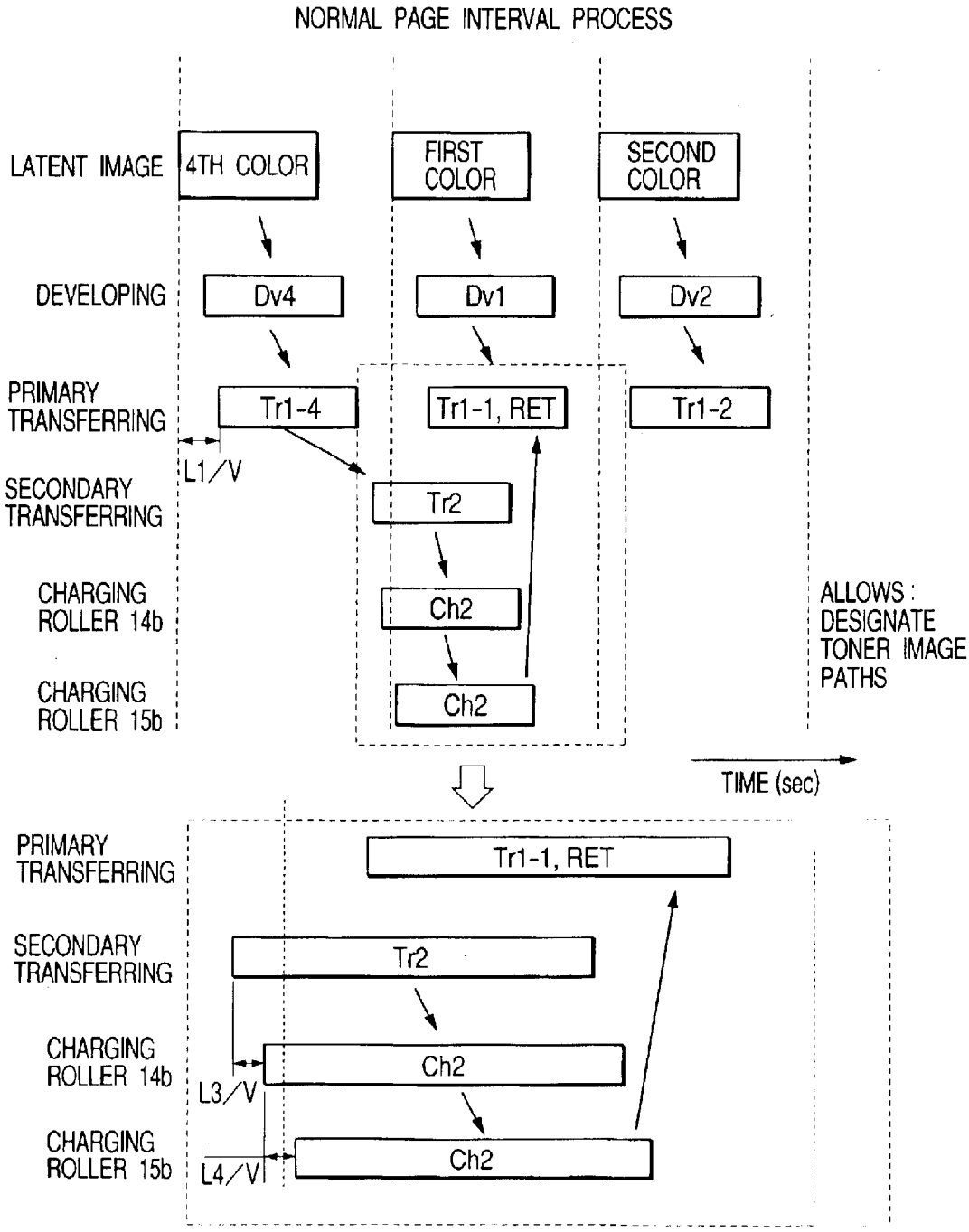
FIG. 5 is a timing chart showing a normal page interval image forming process in the apparatus of FIG. 4.

Here, regarding distances on the intermediate transferring belt 6*a* along the intermediate transferring belt 6*a*, it is assumed that a distance from the secondary transferring portion T2 opposed to the secondary transferring roller 9 to the electrifying roller 14*b* is L3, a distance between the electrifying rollers 14*b* and 15*b* is L4 and a distance from the electrifying roller 15*b* to the primary transferring portion T1 is L5. Members or elements shown by the other symbols are the same as those in FIG. 1. FIG. 5 is a view showing applying timings for various biases, as an example of the normal page interval process and the removal process of adhering toner in this embodiment.

Also in this embodiment, in the continuous image forming process, the cleaning of the electrifying rollers 14*b* and 15*b* is performed. Now, the normal page interval process in the continuous image forming process will be described with reference to FIG. 4.

The image formation is carried out in the same manner as that in the conventional example, and the electrifying of the secondary transferring residual toner as a first mode is carried out in the following manner.

Charges having positive polarity are applied to the secondary transferring residual toner by applying DC voltages having positive polarity to the electrifying rollers 14*b* and 15*b* from the DC voltage power supplies 14*a* and 15*a* when the toner is passed through the electrifying rollers 14*a* and 15*a*. By executing the electrifying twice, the secondary transferring residual toner is electrified more uniformly.

In the apparatus in which the electrifying is executing once as is in the conventional example, depending upon the environment, the secondary transferring residual toner may not be recovered sufficiently at the primary transferring portion to cause the inconvenience such as the poor image. To the contrary, by electrifying the secondary transferring residual toner twice as mentioned above to achieve the uniform electrifying, such an inconvenience can be avoided. Incidentally, since the applying of the voltages to the electrifying rollers 14*b* and 15*b* is carried out by independent power supplies, such applying can be performed at independent timings. Now, the timings will be explained with reference to FIG. 5.

The leading end of the secondary transferring residual toner passes through the electrifying rollers 14*b* and 15*b* after L3/V and (L3+L4)/V, respectively from when the secondary transferring is started. A trailing end also passes through after the same times from when the secondary transferring is finished. Accordingly, the applying of voltages to the electrifying rollers 14*a* and 15*b* is carried out within time ranges delayed with respect to the time range for applying the secondary transferring bias by L3/V and (L3+L4)/V, respectively.

Next, the removal process of adhering toner as a second mode will be explained.

Figure 6:
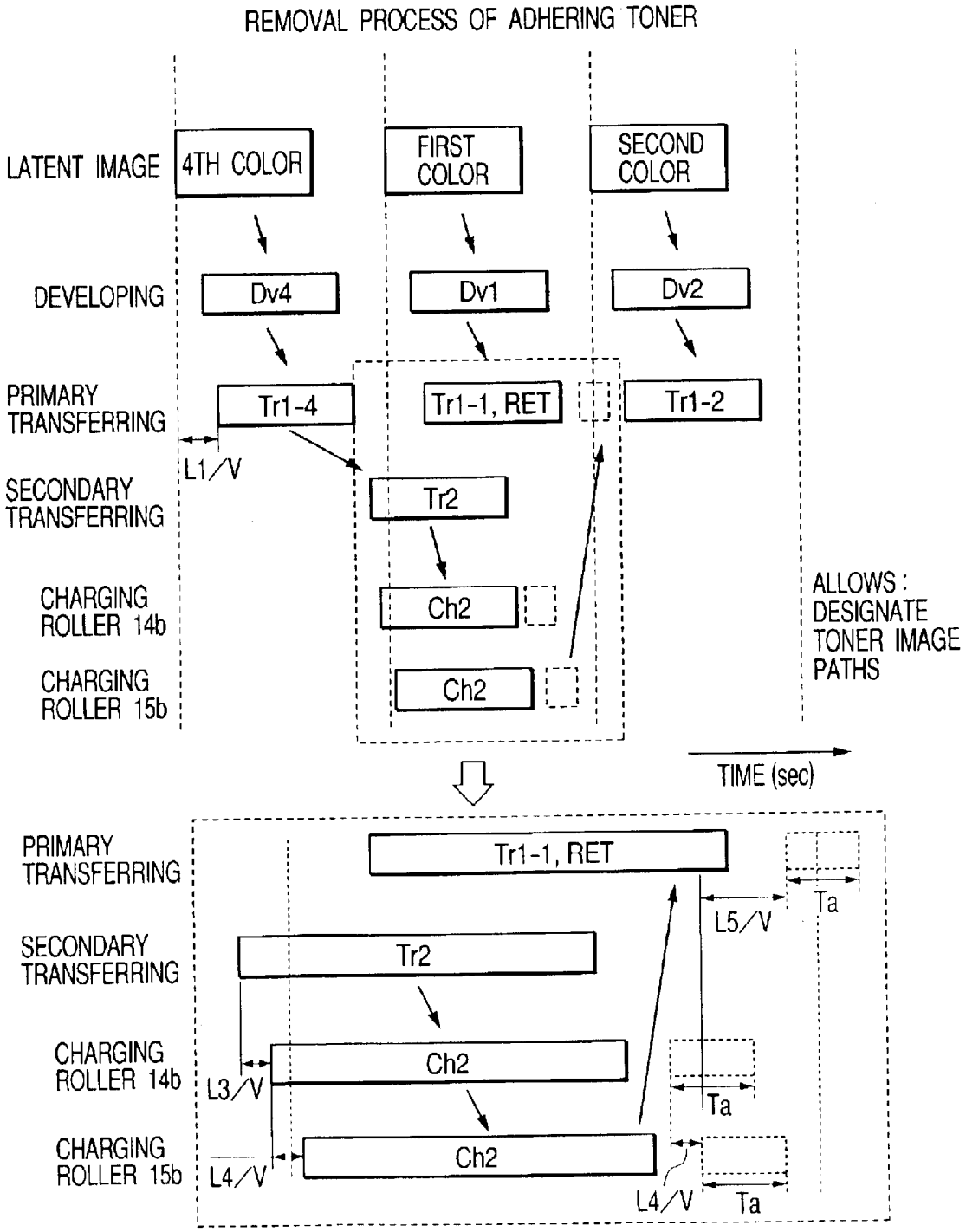
FIG. 6 is a timing chart showing a process for removing adhering toner from an electrifying roller in the apparatus of FIG. 4.

The adhered negative polarity adhering toner is discharged onto the intermediate transferring belt 6*a* by applying the negative polarity biases to the electrifying rollers 14*b* and 15*b*, and then, the entire negative polarity adhering toner discharged from both rollers is recovered onto the photosensitive drum 1 by applying the negative polarity bias to the primary transferring roller 7*b* in synchronism with the timing that the discharged toner passes through the primary transferring portion T1. In this way, the toner is removed. Now, the timings will be explained with reference to FIG. 6.

In this embodiment, similar to the reference example 2, a time for executing the recovering of the adhering toner is set between the first color and the second color during the image formation. Further, the applying of the negative polarity biases to the electrifying rollers 14*b* and 15*b* to enter the discharged toner into the primary transferring portion T1 within the time range permitting the recovering is carried out within time ranges ahead of the time range for applying the negative polarity bias to the primary transferring roller 7*b* by (L4+L5)/V and L5/V, respectively.

The above-mentioned process for discharging the adhering toner onto the second image bearing member by means of the electrifying roller is performed for every predetermined page number while the continuous image forming process is being continued. When all image formations are finished, the post-rotation process is carried out, and the printing sequence is finished.

More specifically, in an A4 mode printing sequence of an image forming apparatus in which a length L6 of the intermediate transferring belt is 442.5 mm and process speed V is 118.0 mm/s and L3, L4 and L5 are 17.7 mm, 17.7 mm and 82.6 mm, respectively, the positive polarity bias is applied to the electrifying roller 14*b*, delayed from the time range for applying the secondary transferring bias by L3/V=0.150 s and the positive polarity bias is applied to the electrifying roller 15*b*, delayed from the time range for applying the secondary transferring bias by (L3+L4)/V=0.300 s.

Further, regarding the applying of the negative polarity bias to the primary transferring roller 7*b* to recover the discharged toner, the negative polarity bias is applied to the primary transferring roller 7*b* to permit the recovering of the toner onto the photosensitive drum 1 within a time duration from when the bias is applied by an amount corresponding to 297 mm from the image leading end regarding the primary transferring for the first color (simultaneously, recovering of the secondary transferring residual toner) to when the primary transferring for the second color is started, i.e. within a predetermined time range of (L6−297)/V=1.233 s, and, further, the applying of the negative polarity biases to the electrifying rollers 14*b* and 15*b* for discharging the adhering toner is performed within time ranges ahead of it by (L4+L5)/V=0.850 s and L5/V=0.700 s, respectively.

The above-mentioned removal process of adhering toner is performed, for example, for every 20 pages in the continuous image forming process in each printing sequence and in the post-rotation process so that the adhering toner is not accumulated on the electrifying roller excessively to avoid the inconvenience such as the poor image.

Incidentally, the number of the electrifying rollers is not limited to two, but, even when three or more electrifying rollers' are provided, the cleaning is performed by deviating the timings similarly.

As such, in this embodiment, since there are provided two electrifying rollers for electrifying the toner remaining on the intermediate transferring belt, when the residual toner is adhered to the electrifying rollers, the amount of the residual toner is dispersed so that an adhering amount of toner per one electrifying roller can be reduced, thereby suppressing deterioration of the electrifying ability.

Further, as is in this embodiment, by performing the discharging of the adhering toner in the way of the image formation, the deterioration of the charging rollers can be prevented more effectively.

By designing so that, from the timing when the transferring of the adhering toner to the intermediate transferring belt 6*a* from the electrifying roller 14*b* (among two electrifying rollers) nearer to the secondary transferring portion T2, after the time during which the intermediate transferring belt 6*a* is rotated by a distance corresponding to the distance L4 between two electrifying rollers 14*b* and 15*b*, the transferring of the adhering toner from the electrifying roller 15*b* to the intermediate transferring belt 6*a* is started, and the transferring of the adhering toner from the electrifying roller 14*b* nearer to the secondary transferring portion T2 to the intermediate transferring belt 6*a* is finished at the similar timing and then the transferring of the adhering toner of the other electrifying roller 15*b* is finished, the removal of the adhering toner regarding at least two electrifying rollers cab be effected within the same time as the recovering time at the longest in one removal process independently from the distance between the electrifying rollers.

As mentioned above, also in the image forming apparatus in which the secondary transferring residual toner is uniformly electrified by the plural electrifying rollers so that the recovering ability for recovering the secondary transferring residual toner onto the photosensitive drum 1 at the primary transferring portion T1 is enhanced, the present invention can be applied, and, similar to the effect shown in the reference examples 1 and 2, it can be seen that the cleaning of the plural electrifying rollers can be effected in the continuous image forming process.

Figure 7:
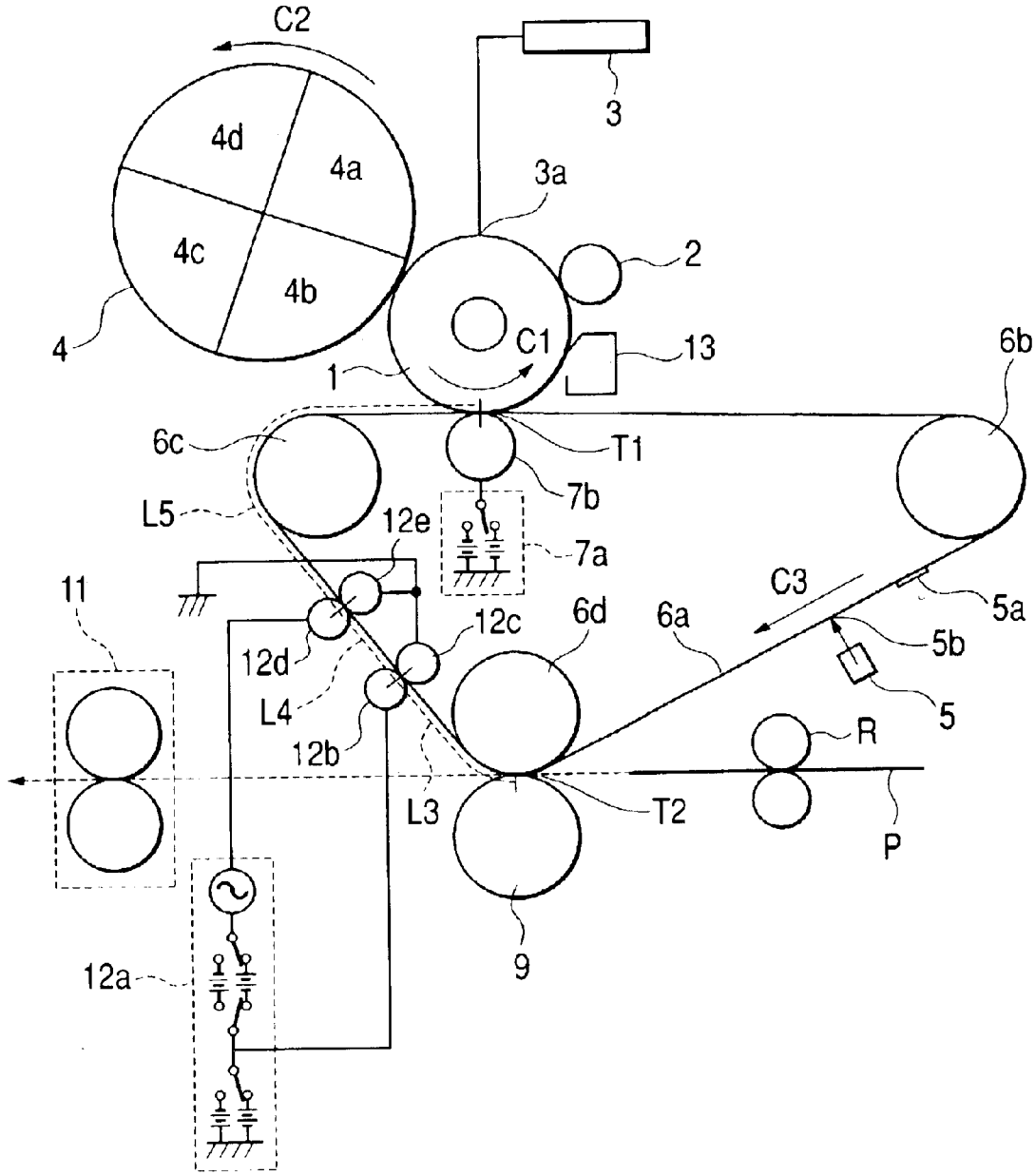
FIG. 7 is a view showing an image forming apparatus according to another embodiment of the present invention.

Next, an embodiment 2 of the present invention will be explained. FIG. 7 is a view showing a color image forming apparatus utilizing an electro-photographic process, as an example of an image forming apparatus according to the present invention. Also in this embodiment, on the intermediate transferring belt 6*a*, there are two electrifying rollers for electrifying the secondary transferring residual toner with positive polarity, i.e. an upstream side electrifying roller 12*b* and a downstream side electrifying roller 12*d* in a shifting direction of the intermediate transferring belt 6*a*. Each of the electrifying rollers 12*b* and 12*d* has an abutment/separation mechanism (not shown) so that the roller can abut against the belt at any time. The electrifying roller 12*b* is disposed at the upstream side of the electrifying roller 12*d* in the shifting direction of the intermediate transferring belt 6*a*. In this embodiment, DC voltage can be applied to the upstream electrifying roller 12*b* by a DC component of the alternating voltage power supply 12*a* and alternating voltage (obtained by overlapping alternating voltage with DC voltage) can be applied to the downstream electrifying roller 12*d* by the alternating voltage power supply 12*a*.

Grounding counter electrodes 12*c* and 12*e* for increasing electrifying efficiencies of the respective electrifying rollers 12*b* and 12*d* are opposed to the electrifying rollers 12*b* and 12*d* with the interposition of the intermediate transferring belt 6*a*.

Figure 8:
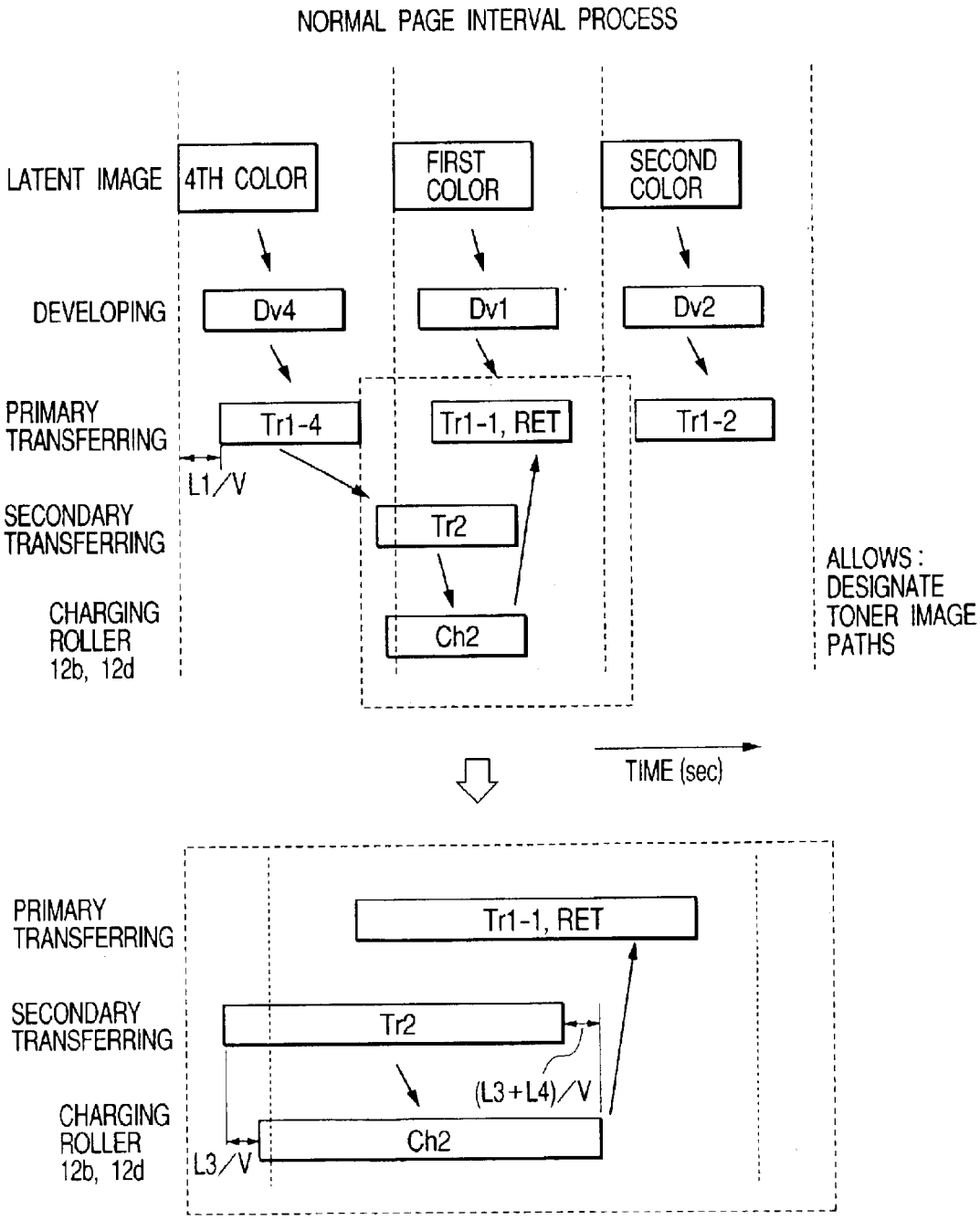
FIG. 8 is a timing chart showing a normal page interval image forming process in the apparatus of FIG. 7.

Here, regarding distances on the intermediate transferring belt 6*a* along the intermediate transferring belt 6*a*, it is assumed that a distance from the secondary transferring portion T2 opposed to the secondary transferring roller 9 to the electrifying roller 12*b* is L3, a distance between the electrifying rollers 12*b* and 12*d* is L4 and a distance from the electrifying roller 12*d* to the primary transferring portion T1 is L5. Members or elements shown by the other symbols are the same as those in FIG. 4. FIG. 8 is a view showing applying timings for various biases, as an example of the normal page interval process and the removal process of adhering toner in the present invention.

Now, the normal page interval process will be explained with reference to FIG. 7.

The image formation is performed in the similar manner to that in the conventional example and the electrifying of the secondary transferring residual toner is performed in the following manner.

Charges having positive polarity are applied to the secondary transferring residual toner by applying DC component of positive polarity voltage to the electrifying roller 12*b* from the voltage power source 12*a* when the toner is passed through the electrifying roller 12*b*. Incidentally, after such electrifying, although charge amounts of respective toner particles are not uniform, the electrifying can be executed while preventing the toner scattering.

Then, charges having positive polarity are applied to the secondary transferring residual toner again by applying alternating voltage having positive polarity to the electrifying roller 12*d* from the alternating voltage power supply 12*a* when the toner is passed through the electrifying roller 12*d*. After such electrifying, the charge amounts of the respective particles are made substantially uniform while maintaining electric polarity of the toner particles to positive polarity.

Incidentally, after the DC electrifying, the electrifying is performed by using alternating voltage. By effecting the electrifying including the alternating bias twice, in comparison with the apparatus in the reference example 2 in which the electrifying of the secondary transferring residual toner is performed twice with the DC voltage, margin of values of the recovering biases for achieving the adequate cleaning ability is further enhanced.

Next, the timings will be explained with reference to FIG. 8.

Since the entire secondary transferring residual toner must be electrified by the above-mentioned electrifying method and the applying of the voltages to the electrifying rollers 12*b* and 12*d* is performed by the single power supply, the applying operations cannot be executed only in the simultaneous manner. Accordingly, a time range during which the voltage applying must be performed is a time duration from when the leading end of the secondary transferring residual toner reaches the electrifying roller 12*b* to when the trailing end reaches the electrifying roller 12*d* and this range is from L3/V after start of the secondary transferring to (L3+L4)/V after end of the secondary transferring.

Figure 9:
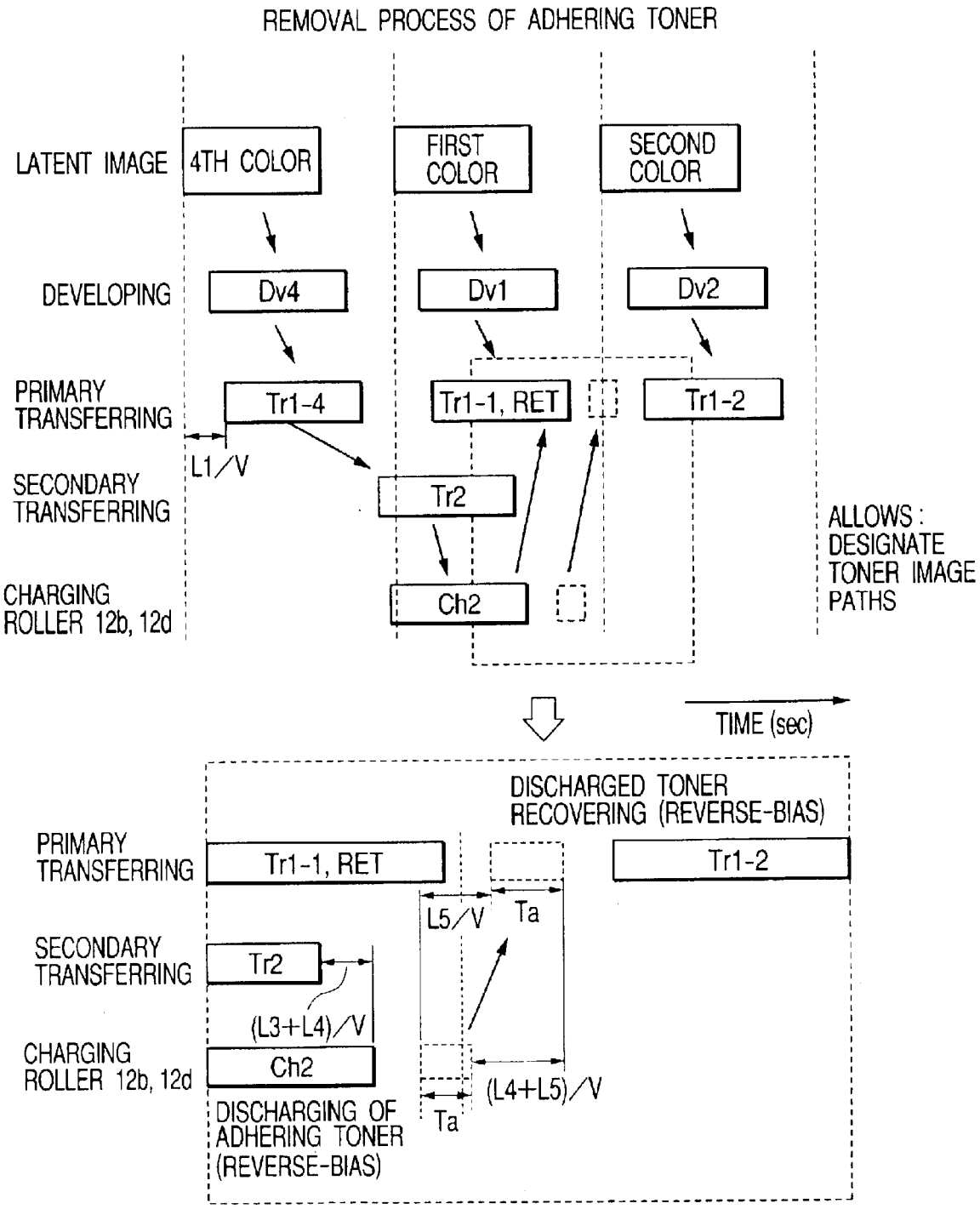
FIG. 9 is a timing chart showing a process for removing adhering toner from an electrifying roller in the apparatus of FIG. 7.

Next, the removal process of adhering toner will be explained. The adhered negative polarity adhering toner is discharged onto the intermediate transferring belt 6*a* by applying the negative polarity biases to the electrifying rollers 12*b* and 12*d*, and then, the entire negative polarity adhering toner discharged from both rollers is recovered onto the photosensitive drum 1 by applying the negative polarity bias to the primary transferring roller 7*b* in synchronous with the timing that the discharged toner passes through the primary transferring portion T1. In this way, the toner is removed. Now, the timings will be explained with reference to FIG. 9.

In this embodiment, similar to the reference example 2, a time for executing the recovering of the adhering toner is set between the first color and the second color during the image formation. Further, in order to enter the discharged toner into the primary transferring portion T1 within the time range permitting the recovering, the portion of the intermediate transferring belt 6*a* which has passed through the electrifying roller 12*d* upon starting of the voltage applying by means of the alternating voltage power supply 12*a* reaches the primary transferring portion T1 when the recovering is started, and the portion of the belt which has passed through the electrifying roller 12*b* upon finishing of the voltage applying from the alternating voltage power supply 12*a* reaches the primary transferring portion T1 when the recovering is finished. That is to say, the negative polarity voltage is applied from L5/V before the start of the recovering to (L4+L5)/V after the end of the recovering, thereby discharging the adhering toner.

The above-mentioned process is performed for every predetermined page number while the continuous image forming process is being continued. When all image formations are finished, the post-rotation process is carried out, and the printing sequence is finished.

More specifically, in an A4 mode printing sequence of an image forming apparatus in which a length L6 of the intermediate transferring belt is 442.5 mm and process speed V is 118.0 mm/s and L3, L4 and L5 are 17.7 mm, 17.7 mm and 82.6 mm, respectively, the positive polarity biases for electrifying the secondary transferring residual toner are applied to the electrifying rollers 12*b* and 14*b* from L3/V=0.150 s after the start of the secondary transferring to (L3+L4)/V=0.300 s after the end of the secondary transferring.

Further, regarding the recovering of the discharged toner, the negative polarity bias is applied to the primary transferring roller 7*b* to permit the recovering of the toner onto the photosensitive drum 1 within a time duration from when the bias is applied by an amount corresponding to 297 mm from the image leading end regarding the primary transferring for the first color (simultaneously, recovering of the secondary transferring residual toner) to when the primary transferring for the second color is started, i.e. within a predetermined time range of (L6−297)/v=1.233 s, and, further, the negative polarity biases are applied to the electrifying rollers 12*b* and 12*d* To effect the discharging from before L5/V=0.700 s to before (L4+L5)/V=0.850 s.

The above-mentioned removal process of adhering toner is performed, for example, for every 20 pages in the continuous image forming process in each printing sequence and in the post-rotation process so that the adhering toner is not accumulated on the electrifying roller excessively to avoid the inconvenience such as the poor image.

In this way, also in this embodiment, the same effect as that in the embodiment 1 can be achieved.

Further, as mentioned above, also in the image forming apparatus in which the secondary transferring residual toner is uniformly electrified by the plural electrifying rollers so that the recovering ability for recovering the secondary transferring residual toner onto the photosensitive drum 1 at the primary transferring portion T1 is enhanced, the present invention can be applied, and, similar to the effect shown in the reference examples 1 and 2, it can be seen that the cleaning of the plural electrifying rollers can be effected in the continuous image forming process.

Incidentally, in the above-mentioned embodiments 1 and 2, while an example that the timing for recovering the adhering toner is set between the first color and the second color during the image formation was explained, as is in the reference example 1, such timing may be set between pages or only in the post-rotation.

Incidentally, this process can similarly be applied to a mono-color printing mode.

Further, the intermediate transferring member is not always limited to the belt but may be a drum, and dimensions, materials, configurations and relative positions of the constructional parts of the above-mentioned image forming apparatus do not limit the scope of the invention to them alone, so long as they are not specifically defined.

Further, when the plurality of electrifying rollers are used, by applying the positive polarity bias in place of the negative polarity bias to the downstream-most electrifying roller to electrify the toner discharged at the upstream side of such a roller with the positive polarity, the recovering of the toner onto the photosensitive drum can be realized with the positive polarity bias as it is, without switching the bias to be applied to the primary transferring roller to the negative polarity as mentioned above.

Figure 13:
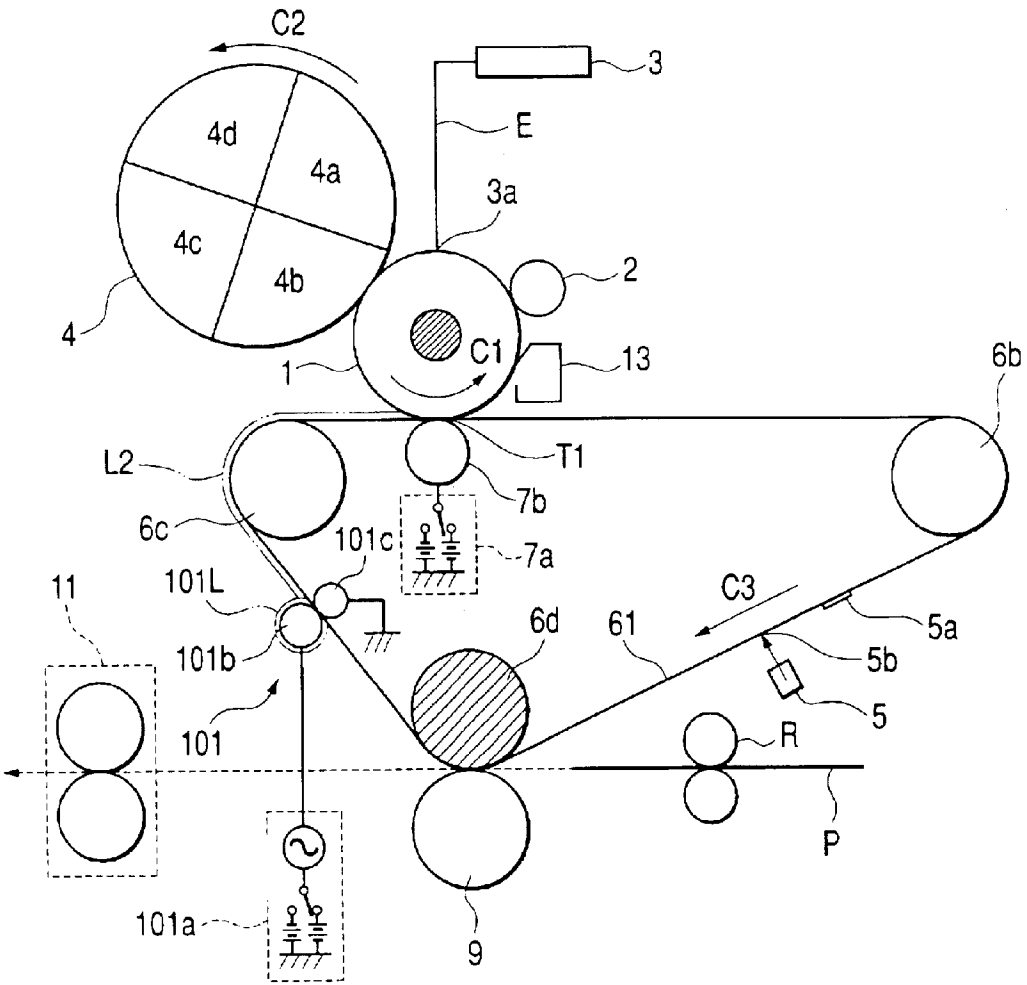
FIG. 13 is a view showing an image forming apparatus as a reference example of the present invention.

Next, further reference example and embodiment will be explained. An image forming apparatus according to the present invention will be described with reference to the accompanying drawings. FIG. 13 is a view for explaining a reference example 3 of the present invention and showing a color image forming apparatus utilizing an electrophotographic process, as an example of an image forming apparatus according to the present invention. In this reference example, an intermediate transferring belt 61 having a circumferential length 61L is used. Elements having the same functions same as those in FIG. 10 are designated by the same reference numerals.

Figure 10:
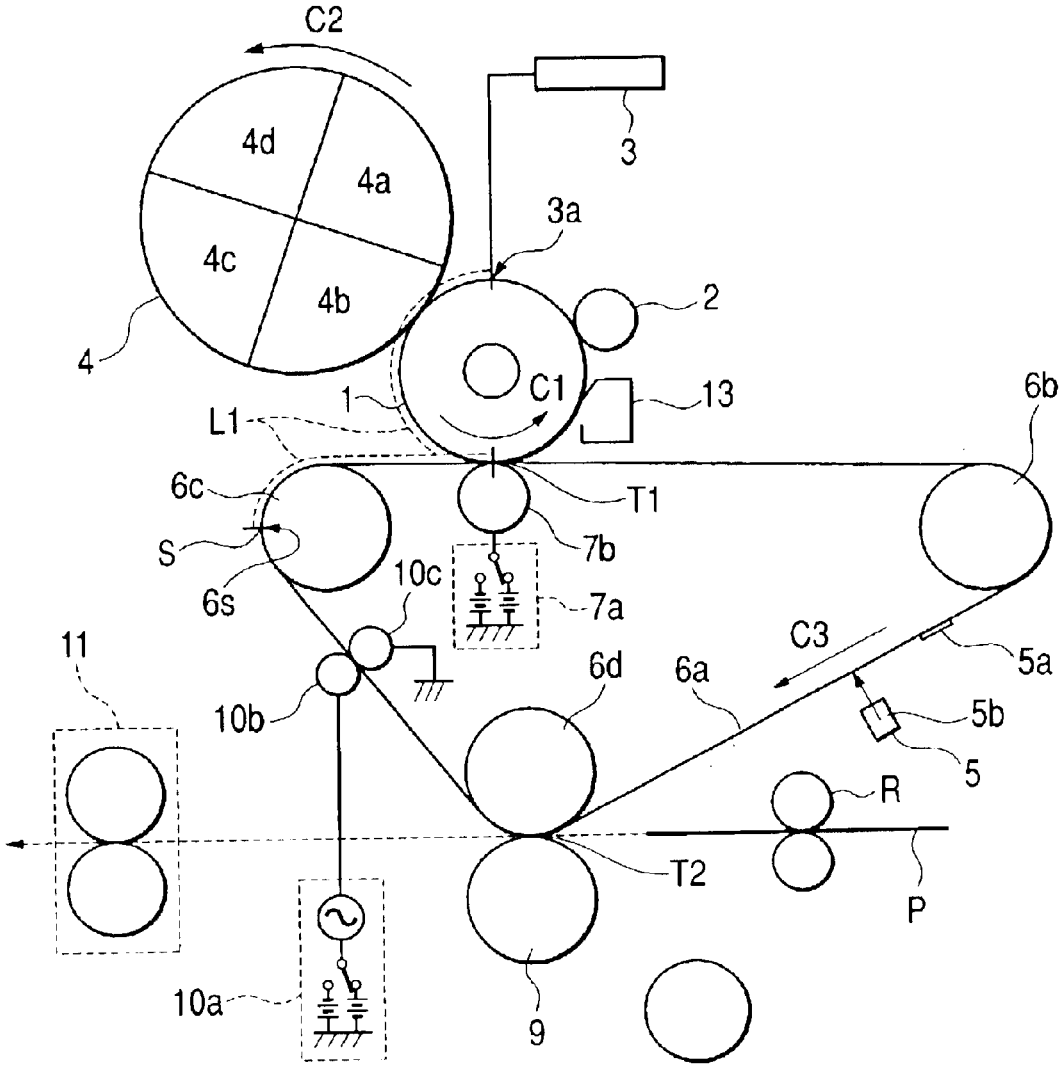
FIG. 10 is a view showing a conventional image forming apparatus.
Figure 11:
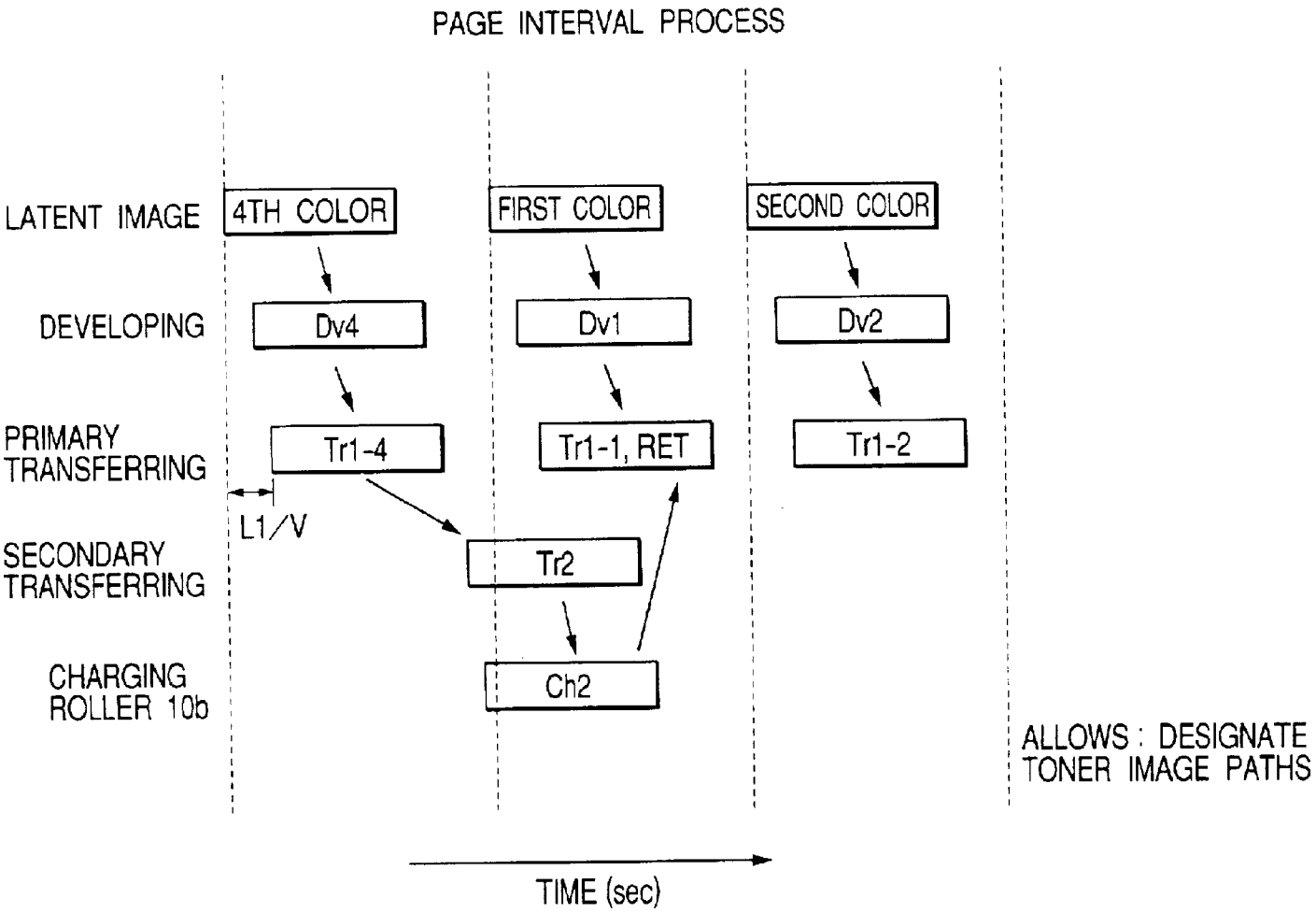
FIG. 11 is a timing chart showing a normal page interval image forming process in the apparatus of FIG. 10.
Figure 12:
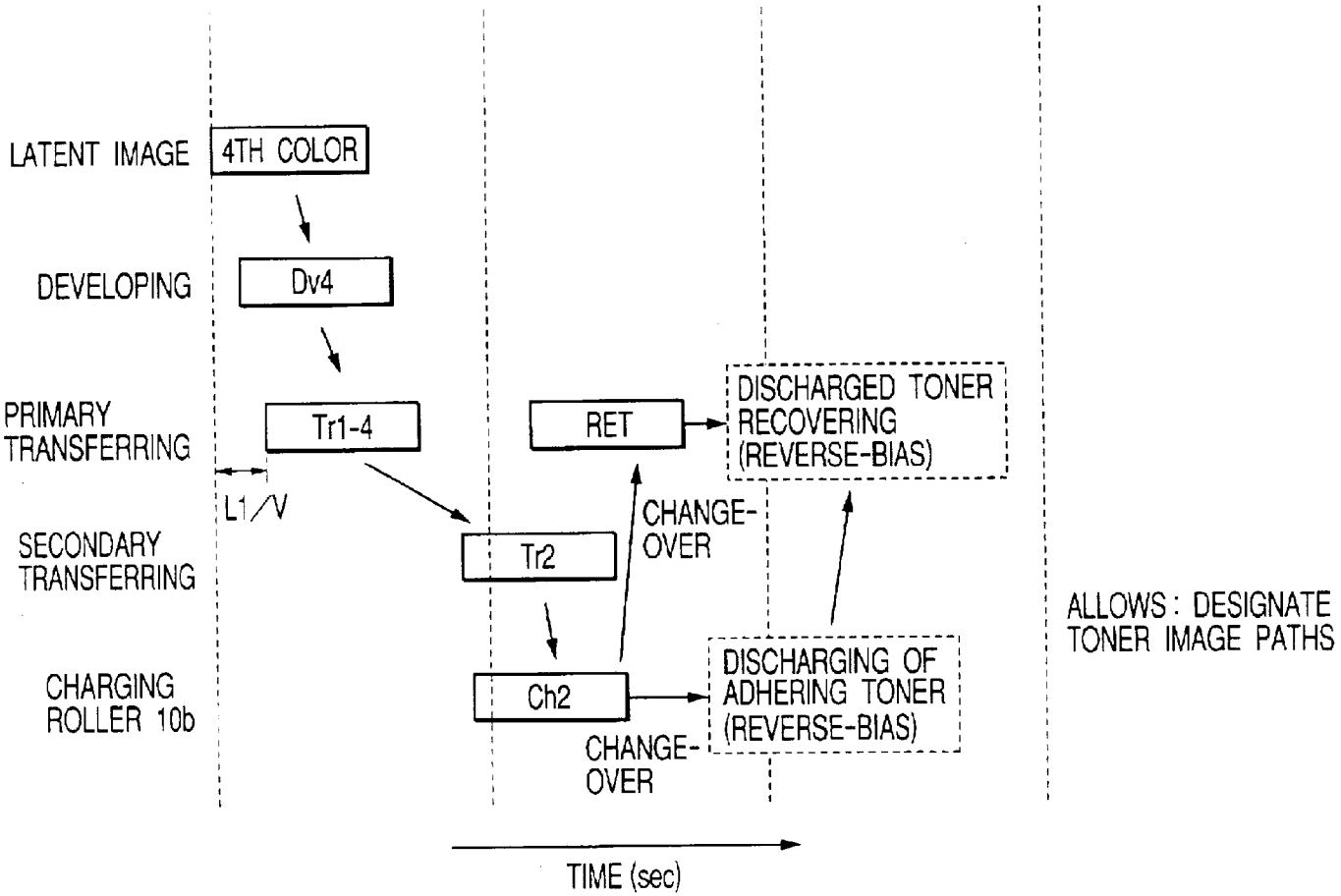
FIG. 12 is a timing chart showing a process for removing adhering toner from an electrifying roller in the apparatus of FIG. 10.

In the image forming apparatus according to this reference example, since an image forming operation effected by respective members other than the operation regarding the removal of the secondary transferring residual toner on the intermediate transferring belt is substantially the same as that in the conventional example shown in FIG. 10, explanation thereof will be omitted here.

Also in the image forming apparatus according to this reference example, plural images can be formed continuously, and a series of operations for forming the image, i.e. a printing sequence includes two processes, i.e. a continuous image forming process in which an image forming process similar to the conventional case and removal process of secondary transferring residual toner are repeated alternately, and a post-rotation process after the last image formation effected by the continuous image forming process.

The image forming apparatus includes second image bearing member electrifying means (charging means) 101 for electrifying the secondary transferring residual toner, and the electrifying means 101 include an electrifying roller 101*b* as an electrifying member having the same construction as the electrifying roller 10*b* in the conventional example and having a circumferential length 101L, an alternating voltage power supply 101*a*, and a grounding counter electrode 101*c*.

In this reference example, in order to executing discharging of adhering developer (adhering toner) from the electrifying roller 101*b* at a non-image portion of the intermediate transferring belt 61, since a non-image portion rotating time during which the intermediate transferring belt 61 is rotated by a distance corresponding to a difference obtained by subtracting a length (L×2) of a formable maximum image in the circumferential direction of the intermediate transferring belt 61 (image maximum circumferential length) from the circumferential length 61L of the intermediate transferring belt must be greater than a rotational period L/V of the electrifying roller 101*b*, there is a following relationship between the image maximum circumferential length (L×2) and the circumferential length 61L of the intermediate transferring belt and the circumferential length 101L of the electrifying roller 101*b* of the image forming apparatus:

$$61L-(L\times 2)>101L \quad (1)$$

Figure 14:
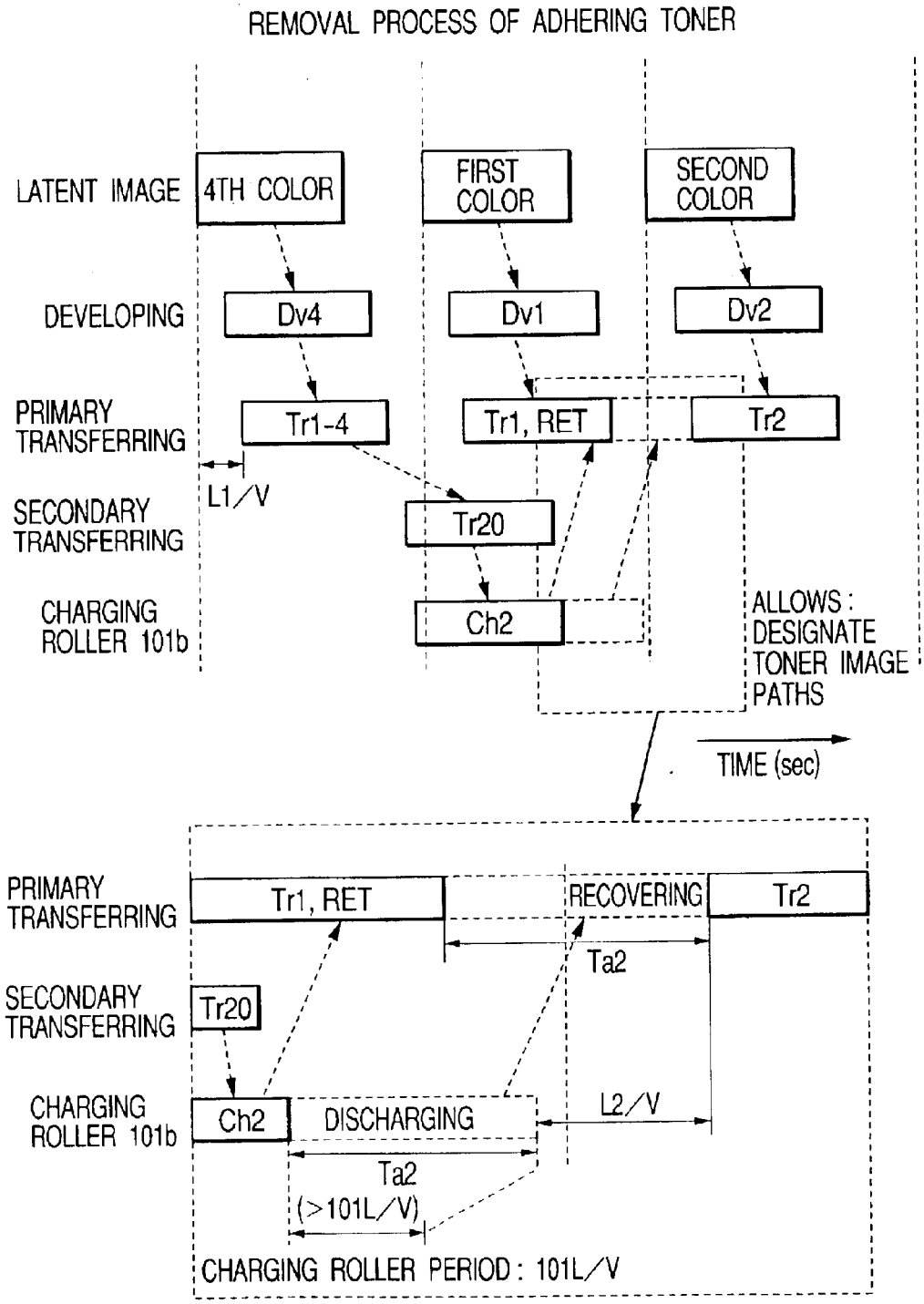
FIG. 14 is a timing chart showing a process for removing adhering toner from an electrifying roller in the apparatus of FIG. 13.

On the other hand, FIG. 14 is a view showing timings for applying various biases in the page interval when the adhering toner is removed in the continuous image forming process in this reference example, and the meanings shown by respective symbols and characters are the same as those in the conventional example.

Now, the removal process of adhering toner will be explained with reference to FIG. 14.

In this reference example, in addition to the image forming process and the removal process of secondary transferring residual toner, which are similar to those in the conventional example, a removal process inherent to this reference example is added.

As shown within the broken line block in FIG. 14, applying of recovering bias in this reference example is performed within a time range from the end of the primary transferring for the first color to the start of the primary transferring of the second color.

Accordingly, a recoverable time Ta2 is represented by the following equation (2):

$$Ta2=(61L-(L\times 2))/V \quad (2)$$

Where, 61L is a circumferential length of the intermediate transferring belt 61, (L×2) is the maximum image length and V is a process speed (peripheral speed of the intermediate transferring belt 61).

In consideration of the equation (1), since Ta2 is greater than a rotational period (101L/V) of the electrifying roller, the discharging of the adhering toner can be executed through one revolution or more of the electrifying roller.

Further, the applying of the discharging bias to the electrifying roller 101*b* is performed for Ta2 same as the recoverable time within a time range ahead of the recoverable time range Ta2 by a time (L2/V) required for shifting the non-image portion of the intermediate transferring belt 61 to the primary transferring portion T1 in order that the discharged toner enters into the primary transferring portion T1 within the recoverable time range Ta2.

Namely, within a non-image portion passing time range from when a leading end of the non-image portion on the intermediate transferring belt 61 passes through the opposed portion of the electrifying roller 101*b* to when a trailing end enters into such an opposed portion, the discharging bias is applied to the electrifying roller 101*b*, thereby transferring the adhering toner on the electrifying roller 101*b* onto the intermediate transferring belt 61.

That is to say, in the printing sequence according to this reference example, although the image forming process and the removal process of secondary transferring toner, which are fundamentally similar to those in the conventional example, are performed in the continuous image forming process, a process adding the removal process of adhering toner is executed for every predetermined page number.

More specifically, a case where the image maximum circumferential length L×2 is 297 mm, the length 61L of the intermediate transferring belt is 432 mm, the process speed V is 120 mm/s, the circumferential length 101L of the electrifying roller is 75.0 mm and L2 is 94.2 mm will be explained.

In the removal process of adhering toner, since the time range Ta2 between the primary transferring for the first color and the primary transferring for the second color is Ta2=(432(mm)−297 (mm))/120 (mm/s)=1.125 s, the recovering bias is applied to the primary transferring roller 7*b* in the time range of Ta2=1.125 s, and the discharging bias is applied to the electrifying roller 101*b* within a time range ahead of the time range Ta2 by L2/V=0.785 s.

By doing so, since the rotational period of the electrifying roller 101*b* is 101L/V=0.625 s and the discharging time is 1.125 s, the cleaning regarding the whole peripheral surface of the roller can be executed by the single removal process of adhering toner.

Of course, the removal of the adhering toner from the electrifying roller is not always executed between the primary transferring of the toner image for the first color and the primary transferring of the toner image for the second color but may be executed between the primary transferring operations for other colors. In this way, in this reference example, since the recovering bias is applied and the adhering toner discharged from the electrifying roller onto the non-image portion of the intermediate transferring belt is recovered between the primary transferring for a certain toner image and the primary transferring for the next toner image, the adhering toner can be removed from the electrifying roller during the continuous image forming process, and thus, even when the page number to be printed in the printing sequence is great, the cleaning performance for the intermediate transferring belt can be maintained. Further, it is not required that the intermediate transferring belt be rotated excessively for the removal process, thereby preventing the image forming speed from being decreased. Namely, in the continuous image forming process, the number of revolutions of the intermediate transferring belt 61 for forming one image is always constant.

Incidentally, since the greater the diameter of the electrifying roller the greater the adhering toner is dispersed, although the electrifying roller has a greater diameter is desirable, as mentioned above, when the peripheral speeds of the intermediate transferring belt, the electrifying roller and the photosensitive drum are equal to each other, since the non-image portion must be lengthened accordingly to lengthen the intermediate transferring belt, the apparatus becomes large-sized. It is a disadvantage.

To avoid this, when the diameter of the electrifying roller is great, there may be provided an additional drive means for increasing the peripheral speed of the electrifying roller with respect to the intermediate transferring belt so that the discharging can be continued by a time corresponding to one revolution or more of the roller within the non-image portion passing time range without lengthening the intermediate transferring belt.

The problem can be solved by executing the above-mentioned removal process of adhering toner for each page or for every several pages in the continuous image forming process so that the adhering toner is not accumulated. Incidentally, this process can similarly be adapted to a mono-color printing mode.

Figure 15:
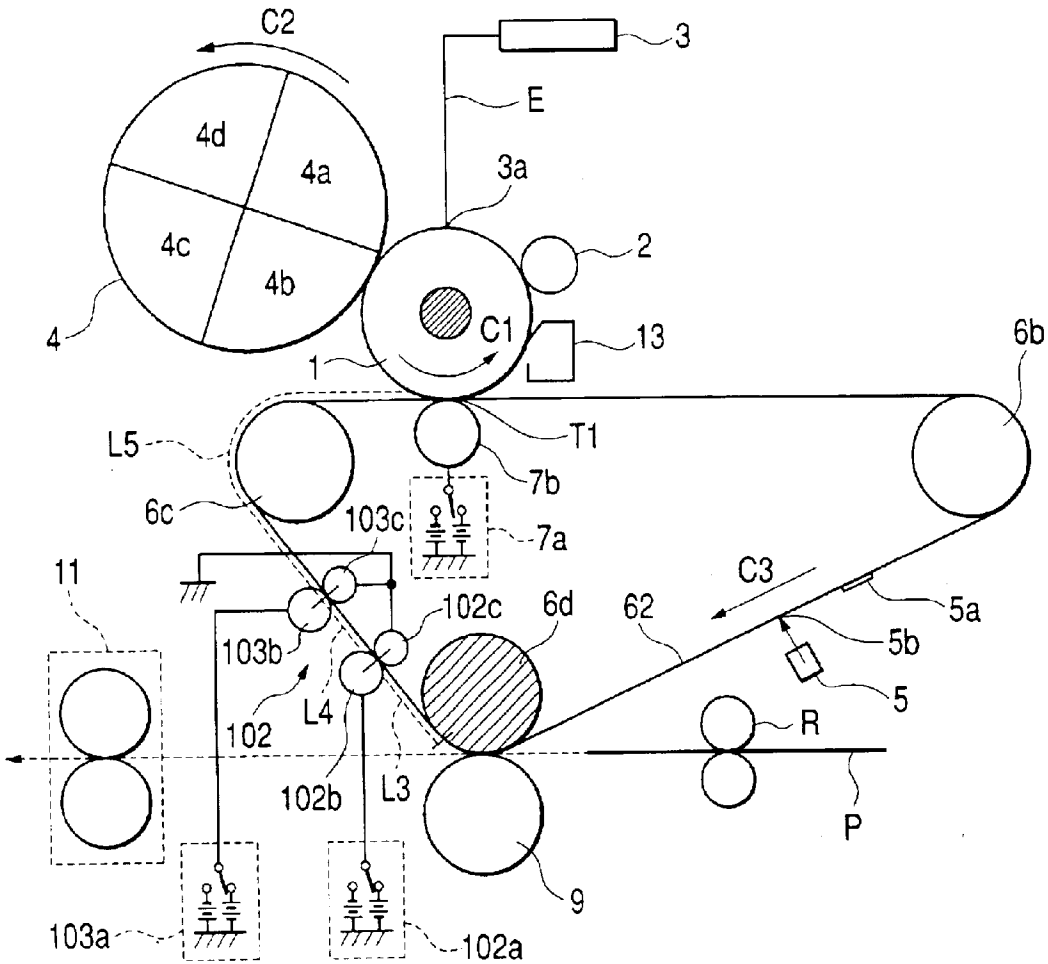
FIG. 15 is a view showing an image forming apparatus according to a further embodiment of the present invention.

FIG. 15 is a view for explaining an embodiment 3 of the present invention and showing a color image forming apparatus utilizing an electro-photographic process, as an example of an image forming apparatus according to the present invention. An intermediate transferring belt 62 has a circumferential length 62L, and, in this embodiment, it is characterized that second image bearing member electrifying means 102 include two electrifying members, i.e. electrifying rollers 102*b* and 103*b*.

The electrifying rollers 102*b* and 103*b* are electrifying rollers having similar construction to that of the electrifying roller 101*b* explained in connection with the reference example 3 and having circumferential lengths 102L and 103L, respectively, and DC voltages can be applied to these rollers by means of DC voltage power supply 102*a* and 103*a*, respectively at independent timings. Further, grounding counter electrodes 102*c* and 103*c* are provided.

Incidentally, in this embodiment, in order to execute the discharging of the adhering toner from both electrifying rollers 102*b* and 103*b* at the non-image portion of the intermediate transferring belt 62, since the non-image portion rotating time during which the intermediate transferring belt 62 is rotated by a distance corresponding to a difference obtained by subtracting the image maximum circumferential length (L×3) from the circumferential length 62L of the intermediate transferring belt must be greater than rotational periods 102L/V and 103L/V of the electrifying rollers 102*b* and 103*b*, there is a following relationship between the image maximum circumferential length (L×3) and the circumferential length 62L of the intermediate transferring belt and the circumferential length 102L and 103L of the electrifying rollers of the image forming apparatus:

$$62L-(L\times 3)>102L,\ 103L \tag{3}$$

Figure 16:
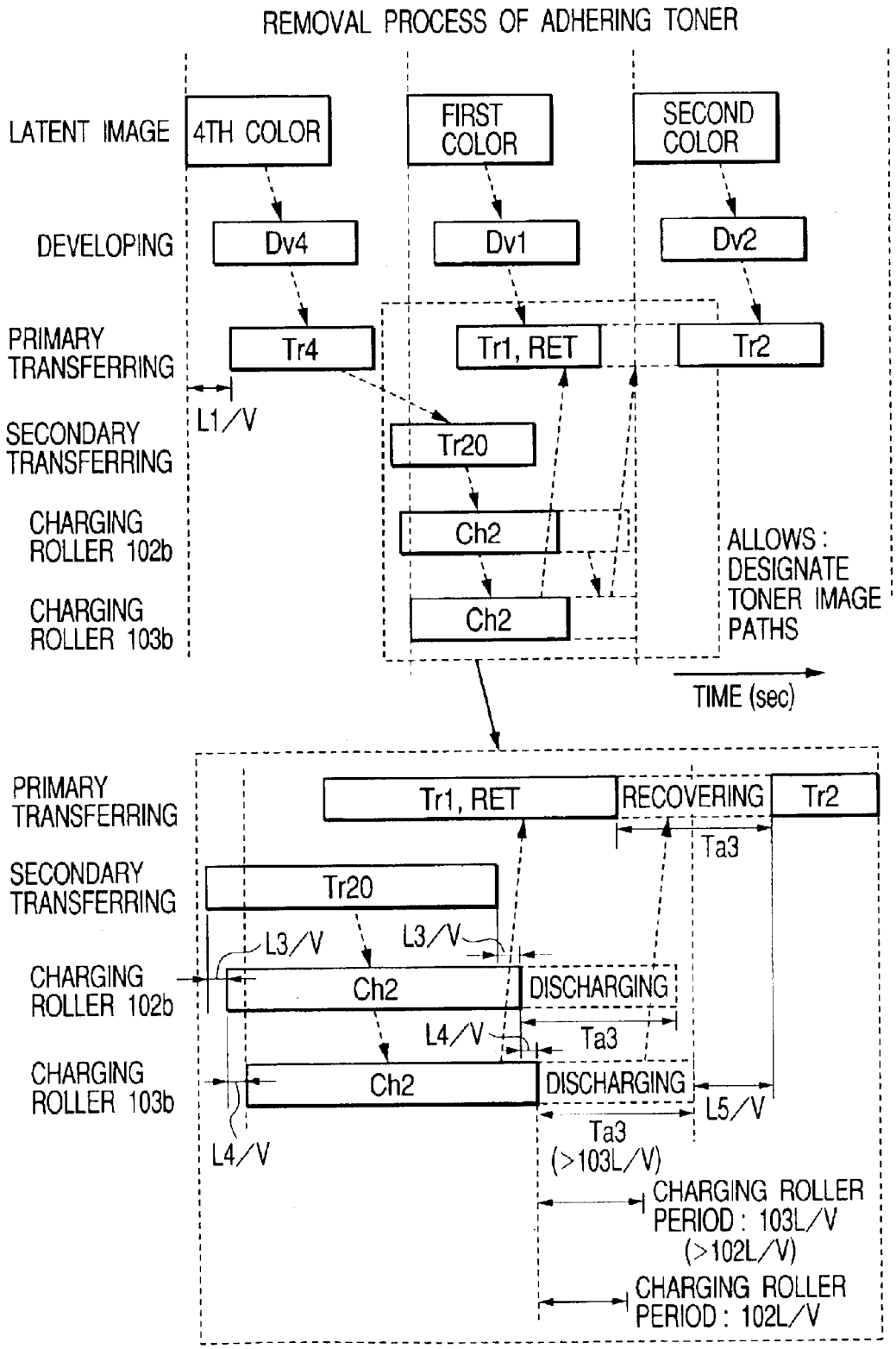
FIG. 16 is a timing chart showing a process for removing adhering toner from an electrifying roller in the apparatus of FIG. 15.

It is assumed that distances between the adjacent secondary transferring roller 9, electrifying rollers 102*b* and 103*b* and primary transferring roller 7*b* on the intermediate transferring belt 61 are L2, L3 and L4, respectively. Members or elements shown by the other symbols are the same as those in FIG. 13. FIG. 16 is a view showing timings for applying various biases in the page interval when the adhering toner is removed in the continuous image forming process in the present invention. As shown within the broken line block in FIG. 16, also in this embodiment, the applying of the recovering bias is performed within a time range from the end of the primary transferring for the first color to the start of the primary transferring of the second color. In this embodiment, a removal process of secondary transferring residual toner and a removal process of adhering toner, which are inherent to the present invention, are added to the image forming process similar to that in the conventional example.

Now, the removal process of secondary transferring residual toner will be explained with reference to FIG. 16.

Charges having positive polarity are applied to the secondary transferring residual toner twice by applying DC voltage having positive polarity to the electrifying rollers 102*b* and 103*b* from DC voltage power supplies 102*a* and 103*a* when the residual toner passes through the electrifying rollers 102*b* and 103*b*. By doing so, the secondary transferring residual toner is electrified more uniformly.

As is in the reference example 3, in the apparatus in which the electrifying of the secondary transferring residual toner is performed only once, depending upon the environment, the residual toner is not electrified adequately not to be recovered sufficiently at the primary transferring portion, thereby causing inconvenience such as the poor image. To the contrary, by effecting the electrifying twice as mentioned above, the uniform electrifying can be achieved to improve such inconvenience.

As shown by a process Ch2 in FIG. 16, the secondary transferring residual toner passes through the electrifying roller 102*b* within a time range delayed, by L3/V, from the time range in which the secondary transferring is executed and passes through the electrifying roller 103*b* within a time range further delayed by L4/V.

Accordingly, the applying of the discharging biases to the respective electrifying rollers 102*b* and 103*b* is executed within time ranges delayed, by L/3V and (L3+L4)/V, respectively from the time range in which the secondary transferring is executed.

Next, the removal process of adhering toner from the electrifying rollers 102*b* and 103*b* will be explained with reference to FIG. 16.

By applying negative polarity biases to the respective electrifying rollers 102*b* and 103*b*, the adhered negative polarity toner is discharged and transferred onto the intermediate transferring belt 62. In this case, however, the biases are applied at independent timings so that the toners transferred from the respective electrifying rollers 102*b* and 103*b* are overlapped on the intermediate transferring belt 62.

By applying the recovering bias to recover the toner onto the photosensitive drum 1 at timing when the negative polarity toner discharged from both electrifying rollers 102*b* and 103*b* and overlapped passes through the primary transferring portion T1, the removal of the toner is carried out.

Incidentally, in this embodiment, the recoverable time is indicated by Ta3.

Similar to the reference example 3, the applying of the recovering bias is performed within a time range from the end of the primary transferring for the first color to the primary transferring for the second color. Thus, the recoverable time Ta3 is represented by the following equation (4):

$$Ta3=(62L-(L\times 3))/V \tag{4}$$

Further, the applying of the negative polarity biases to the respective electrifying rollers 102*b* and 103*b* are executed for Ta3 same as the recoverable time within time ranges ahead of the time range in which the negative polarity bias is applied to the primary transferring roller 7*b* by (L4+L5)/V and L4/V, respectively in order that the discharged toner enters into the primary transferring portion T1 within the recoverable time range.

Incidentally, considering the equations (3) and (4), since Ta3 is greater than rotational periods (102L/V) and (103L/V) of two electrifying rollers, the discharging of the toner can be executed through one revolution or more with respect to the respective electrifying rollers 102*b* and 103*b*.

In the printing sequence, in the continuous image forming process, the image forming process substantially similar to that in the conventional example and the above-mentioned removal process of secondary transferring residual toner are carried out, and, the above-mentioned removal process of adhering toner is additionally carried out for every predetermined page number. Further, the post-rotation process is executed after the continuous image forming process.

More specifically, when the image maximum circumferential length (L×3) is 297 mm, the length 62L of the intermediate transferring belt is 432 mm, the process speed V is 120 mm/s, the circumferential lengths 102L and 103L of the electrifying rollers are 75.0 mm and 90.0 mm, respectively, and L3, L4 and L5 are 18.0 mm, 18.0 mm and 84.0 mm, respectively, in the removal process of secondary transferring residual toner, the positive polarity bias is applied to the electrifying roller 102*b*, delayed, by L3/V=0.150 s, from the time range in which the secondary transferring is executed, and the positive polarity bias is applied to the electrifying roller 103*b*, further delayed by L4/V=0.150 s.

Further, in the removal process of adhering toner, within a time range of Ta3=(62L−(L×3))/V=(432(mm)=297(mm))/120(mm/s)=1.125 s between the primary transferring for the first color and the primary transferring for the second color, the recovering bias is applied to the primary transferring roller 7*b*, and, the discharging biases are applied to the electrifying rollers 102*b* and 103*b* within time ranges ahead of the above time range by (L4+L5)/V=0.850 s and L5/V=0.700 s, respectively.

Since the rotational periods of the electrifying rollers 102*b* and 103*b* are 102L/V=0.625 s and 103L/V=0.750 s, respectively and the discharging time is 1.125 s, the whole peripheral surfaces of two electrifying rollers 102*b* and 103*b* can be cleaned by the single removal process of adhering toner.

Figure 17:
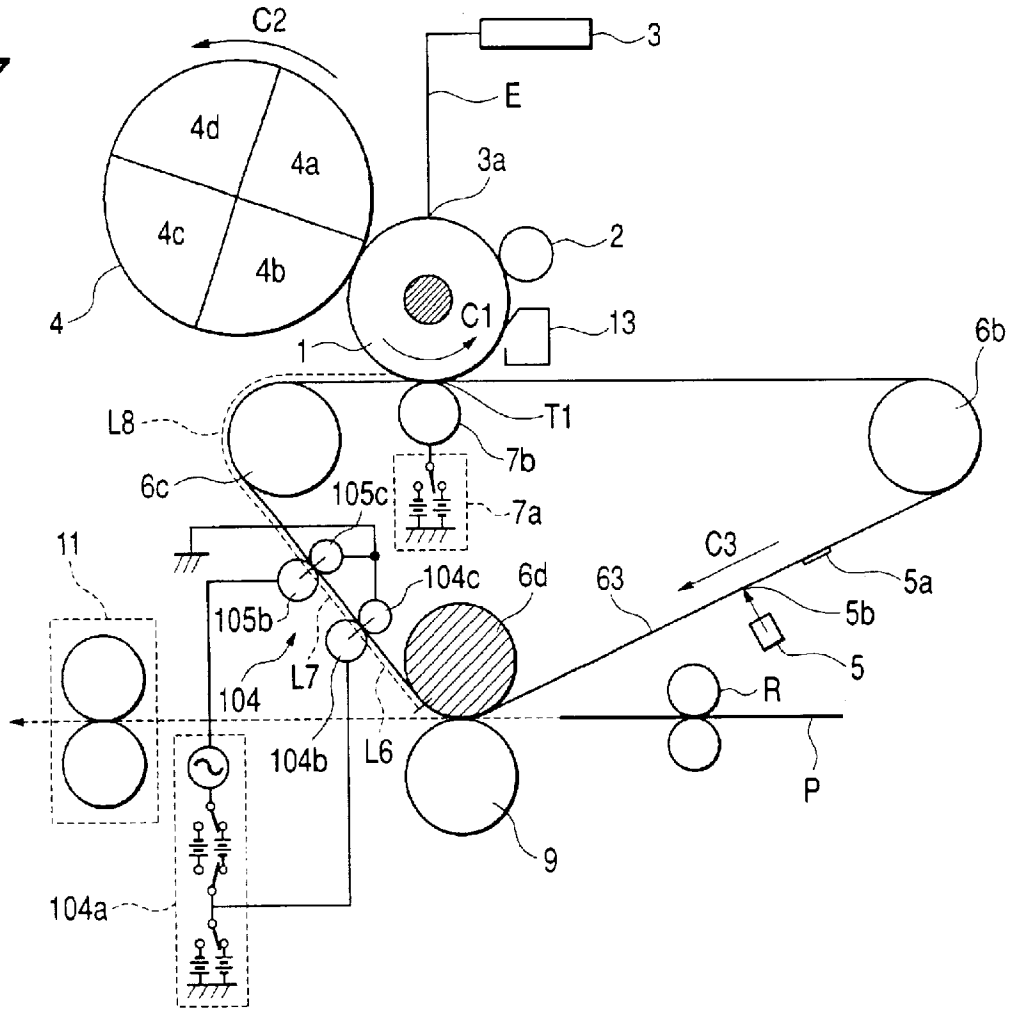
FIG. 17 is a view showing an image forming apparatus according to a still further embodiment of the present invention.

FIG. 17 is a view for explaining an embodiment 4 of the present invention and showing a color image forming apparatus utilizing an electro-photographic process, as an example of an image forming apparatus according to the present invention. An intermediate transferring belt 63 has a circumferential length 63L.

Also in this embodiment, similar to the embodiment 3, second image bearing member electrifying means 104 for electrifying the intermediate transferring belt 63 include two electrifying members, i.e. electrifying rollers 104*b* and 105*b*. The electrifying rollers 104*b* and 105*b* have the same constructions as the electrifying rollers 102*b* and 103*b* explained in connection with the embodiment 3.

The electrifying rollers 104*b* and 105*b* are electrifying rollers having circumferential lengths 104L and 105L, respectively. Here, it is assumed as 105L>104L. Each electrifying roller has an abutment/separation mechanism (not shown) with respect to the intermediate transferring belt 63 so that the roller can abut against the belt at any time.

Different from the embodiment 3, biases are applied to two electrifying rollers 104*b* and 105*b* simultaneously from a single power supply 104*a*. The power supply 104*a* can supply DC voltage to the electrifying roller 104*b* and alternating voltage to the electrifying roller 105*b* simultaneously. Further, grounding counter electrodes 104*c* and 105*c* are provided.

Incidentally, in this embodiment, in order to carry out the discharging of the adhering toner from both electrifying rollers 104*b* and 105*b* at the non-image portion of the intermediate transferring belt 63, the non-image portion rotating time during which the intermediate transferring belt 63 is rotated by a distance corresponding to a difference obtained by subtracting the image maximum circumferential length (L×4) from the circumferential length 63L of the intermediate transferring belt must be greater than the greater rotational period 105L/V. Further, as is in this embodiment, when the discharging biases are applied to two electrifying rollers 104*b* and 105*b* simultaneously, since a distance obtained by subtracting a distance L7 between two rollers and the image maximum circumferential length (L×4) from the circumferential length 63L of the belt is greater than the circumferential length 105L of the roller 105*b*, there is the following relationship (5) between the image maximum circumferential length (L×4) and 63L and 104L and 105L of the image forming apparatus:

$$63L-(L\times 4)-L7>105L>104L \quad (5)$$

It is assumed that distances between the adjacent secondary transferring roller 9, electrifying rollers 104*b* and 105*b* and primary transferring roller 7*b* on the intermediate transferring belt 63 are L6, L7 and L8, respectively. Members or elements shown by other symbols are the same as those in FIG. 15.

Figure 18:
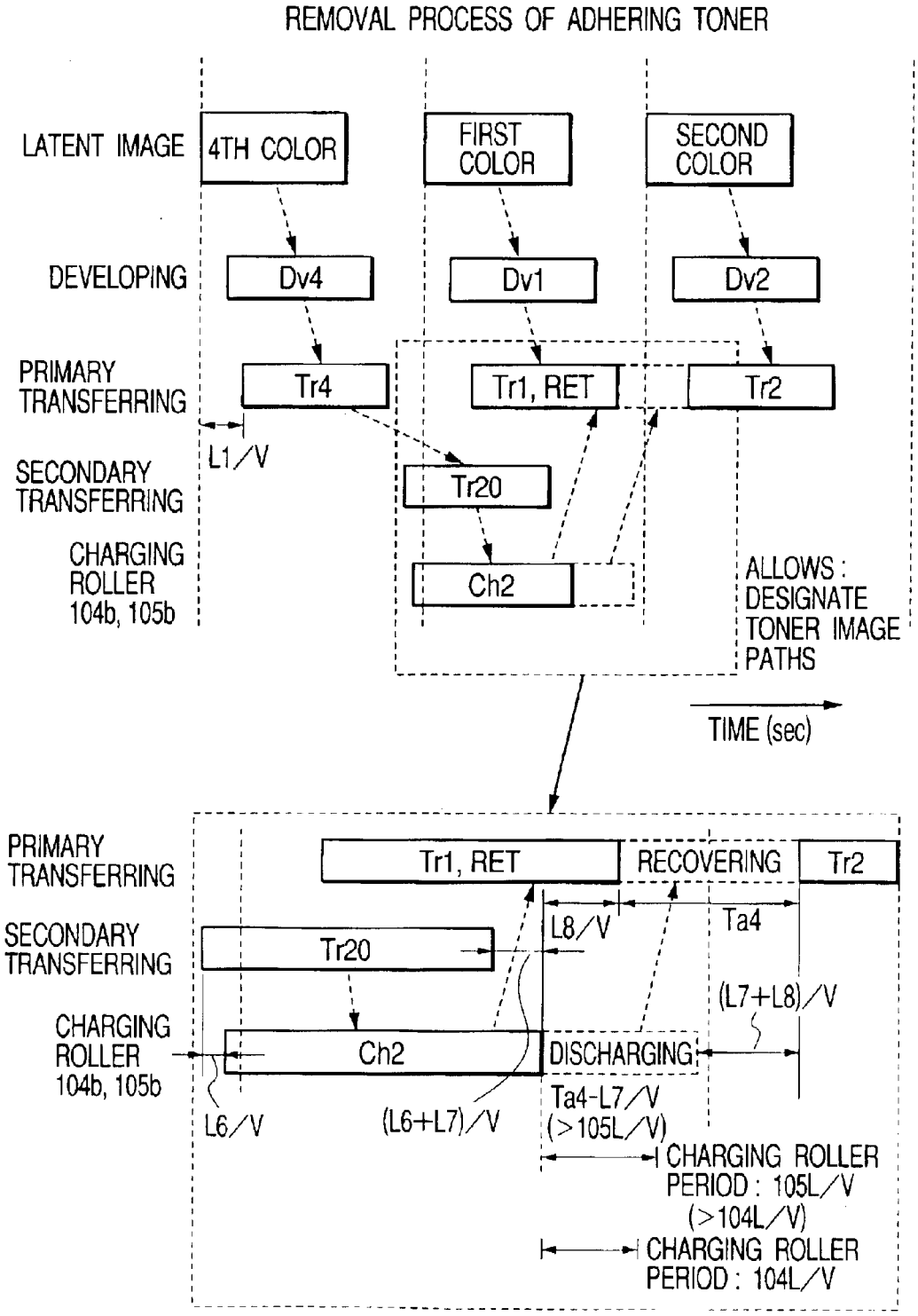
FIG. 18 is a timing chart showing a process for removing adhering toner from an electrifying roller in the apparatus of FIG. 17.

FIG. 18 is a view showing timings for applying various biases in the page interval when the removal of the adhering toner is executed in the continuous image forming process in the present invention. As shown by the broken line block in FIG. 18, also in this embodiment, the applying of the recovering bias is performed within a time range between the end of the primary transferring for the first color and the start of the primary transferring for the second color. In this embodiment, a removal process of secondary transferring residual toner and a removal process of adhering toner, which are inherent to the present invention, are added to the image forming process similar to that in the conventional example.

Now, the removal process of secondary transferring residual toner will be explained with reference to FIG. 17.

Charges having positive polarity are applied to the secondary transferring residual toner by applying a DC component voltage having positive polarity to the electrifying roller 104 from the alternating voltage power supply 104*a* when the residual toner passes through the electrifying roller 104*b*. Incidentally, after such electrifying, although charged amounts of respective toner particles are not uniform, the electrifying can be carried out while suppressing the toner scattering.

Then, charges having positive polarity are applied again by applying the alternating voltage having positive polarity to the electrifying roller 105*b* from the power supply 104*a* when the residual toner passes through the electrifying roller 105*b*. By such electrifying, the charged amounts of the respective particles are made uniform while maintaining the electric polarity of the toner particles to positive polarity.

Incidentally, by performing the electrifying twice, in comparison with the apparatus in which the secondary transferring residual toner is electrified twice with the DC voltage, when the second electrifying is executed by using the alternating voltage, margin for recovering bias values for realizing the adequate cleaning is further enhanced.

Next, the timings will be explained with reference to FIG. 18.

Since the entire secondary transferring residual toner must be electrified by the above-mentioned electrifying method and the applying of the voltages to the electrifying rollers 104*b* and 105*b* cannot be executed only in the simultaneous manner.

Accordingly, a time range during which the voltage applying must be performed is a time duration from when the leading end of the secondary transferring residual toner enters onto the electrifying roller 104*b* at an upstream side in a rotational direction of the intermediate transferring belt 63 to when the trailing end passes through the downstream electrifying roller 105*b* and this range is from L6/V after start of the secondary transferring to (L6+L7)/V after end of the secondary transferring.

Next, the removal process of adhering toner will be explained with reference to FIG. 17.

The adhered negative polarity adhering toner is discharged onto the intermediate transferring belt 63 by applying the negative polarity biases to the electrifying rollers 104*b* and 105*b*, and then, the recovering biases are applied to recover the toner onto the photosensitive drum 1 at the timing when the negative polarity toner discharged from both rollers passes through the primary transferring portion T1. In this way, the toner is removed. Now, the timings will be explained with reference to FIG. 18.

Incidentally, a recoverable time is indicated by Ta4.

The applying of the recovering bias is performed within a time range from the end of the primary transferring for the first color to the primary transferring for the second color. Thus, the recoverable time Ta4 is represented by the following equation (6):

$$Ta4(63L-(L\times4))/V \quad (6)$$

Further, in order to pass the entire discharged toner through the primary transferring portion within the recoverable time range, the portion of the intermediate transferring belt 63 which has passed through the electrifying roller 105*b* upon starting of the voltage applying by means of the power supply 104*a* reaches the primary transferring portion T1 when the recovering is started, and the portion of the belt which has passed through the electrifying roller 104*b* upon finishing of the voltage applying from the power supply 104*a* reaches the primary transferring portion T1 when the recovering is finished.

That is to say, the discharging biases are applied from L8/V before the start of the recovering to (L7+L8)/V after the end of the recovering. Accordingly, the discharging time is Ta4+L8/V−(L7+L8)/V=Ta4−L7/V, i.e. (63L−(L×4)−L7).

If the equation (5) is satisfied, since it is greater than the rotational periods (104L/V) and (105L/V) of two electrifying rollers, with respect to the respective electrifying rollers 104*b* and 105*b*, the discharging of the adhering toner can be performed through one revolution or more.

In consideration of the above matters, the following relationship (7) is established:

$$(63L-(L\times4)-L7)/V>105L/V>104L/V \quad (7)$$

From this relationship, the following relationship (8) is derived:

$$(63L-(L\times4))/V>105L/V+L7/V \quad (8)$$

Namely, in the case where the second image bearing member electrifying means have two electrifying rollers 104*b* and 105*b* and the voltages are applied to the electrifying rollers 104*b* and 105*b* simultaneously from the single power supply 104*a*, so long as the sum of the time during which the intermediate transferring belt 63 is rotated by the distance L7 between two electrifying rollers 104*b* and 105*b* and the greater rotational period 105L/V among two electrifying rollers 104*b* and 105*b* is smaller than the non-image portion rotating time of the intermediate transferring belt 63, the discharging of the adhering toner can be executed through one revolution or more, with respect to the respective electrifying rollers 104*b* and 105*b*.

In the printing sequence, in the continuous image forming process, the image forming process substantially similar to that in the conventional example and the above-mentioned removal process of secondary transferring residual toner are carried out, and, the above-mentioned removal process of adhering toner is additionally carried out for every predetermined page number. Further, the post-rotation process is executed after the continuous image forming process.

More specifically, when the image maximum circumferential length (L×4) is 297 mm, the length 63L of the intermediate transferring belt is 432 mm, the process speed V is 120 mm/s, the circumferential lengths 104L and 105L of the electrifying rollers are 75.0 mm and 90.0 mm, respectively, and L6, L7 and L8 are 18.0 mm, 18.0 mm and 84.0 mm, respectively, in the removal process of secondary transferring residual toner, the positive polarity biases for electrifying the secondary transferring residual toner are applied to the electrifying rollers 104*b* and 105*b* from L6/V=0.150 s after the start of the secondary transferring to (L6+L7)/V=0.300s after the end of the secondary transferring.

Further, in the removal process of adhering toner, within a time range of Ta4=1.125 s between the primary transferring for the first color and the primary transferring for the second color, the recovering bias is applied to the primary transferring roller 7*b*, and, the discharging biases are applied to the electrifying rollers 104*b* and 105*b* within time ranges ahead of the above time range by L8/V=0.700 s and (L7+L8)/V=0.850 s, respectively.

Since the rotational periods of the electrifying rollers 104*b* and 105*b* are 104L/V=0.625 s and 105L/V=0.750 s, respectively and the discharging time is (63L−(L×4)−L7)/V=0.975 s, the whole peripheral surfaces of two electrifying rollers 104*b* and 105*b* can be cleaned by the single removal process of adhering toner.

Incidentally, while an example that the diameter of the downstream electrifying means is greater than that of the upstream electrifying means was explained, if vice versa, by adopting a design obtained on the basis of the similar calculations, the whole peripheral surfaces of two electrifying rollers can be cleaned by the single removal process of adhering toner.

Further, while an example that the adhering toner is discharged from both electrifying rollers 104*b* and 105*b* in the removal process of adhering toner was explained, when only the upstream electrifying roller 104*b* is desired to be cleaned, the negative polarity bias may be applied to the roller 104*b* and the positive polarity bias may be applied to the roller 105*b*.

By doing so, the toner polarity upon recovering becomes the positive polarity, thereby providing advantages that the recovering bias can be the positive polarity bias common to the bias for the primary transferring of the image and that the switching time for switching to the recovering bias is not required and, thus, adequate discharging time can be obtained.

Incidentally, three or more electrifying rollers may be used. In such a case, it is preferred that the DV voltage is applied to the electrifying roller farthest from the secondary transferring portion and the alternating voltage is applied to at least one of the other electrifying rollers.

Figure 19:
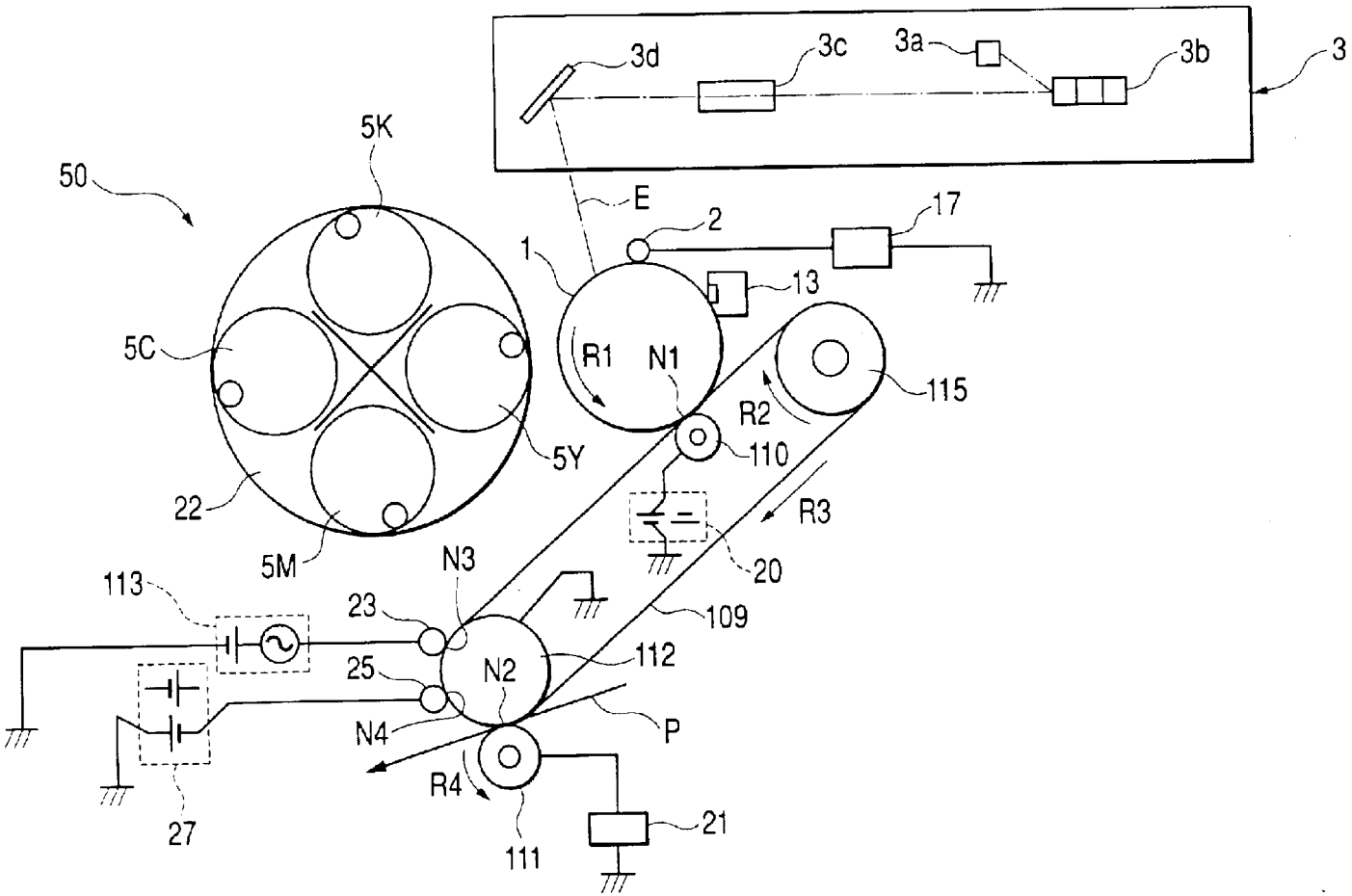
FIG. 19 is a view showing an image forming apparatus according to a further embodiment of the present invention.
Figure 20:
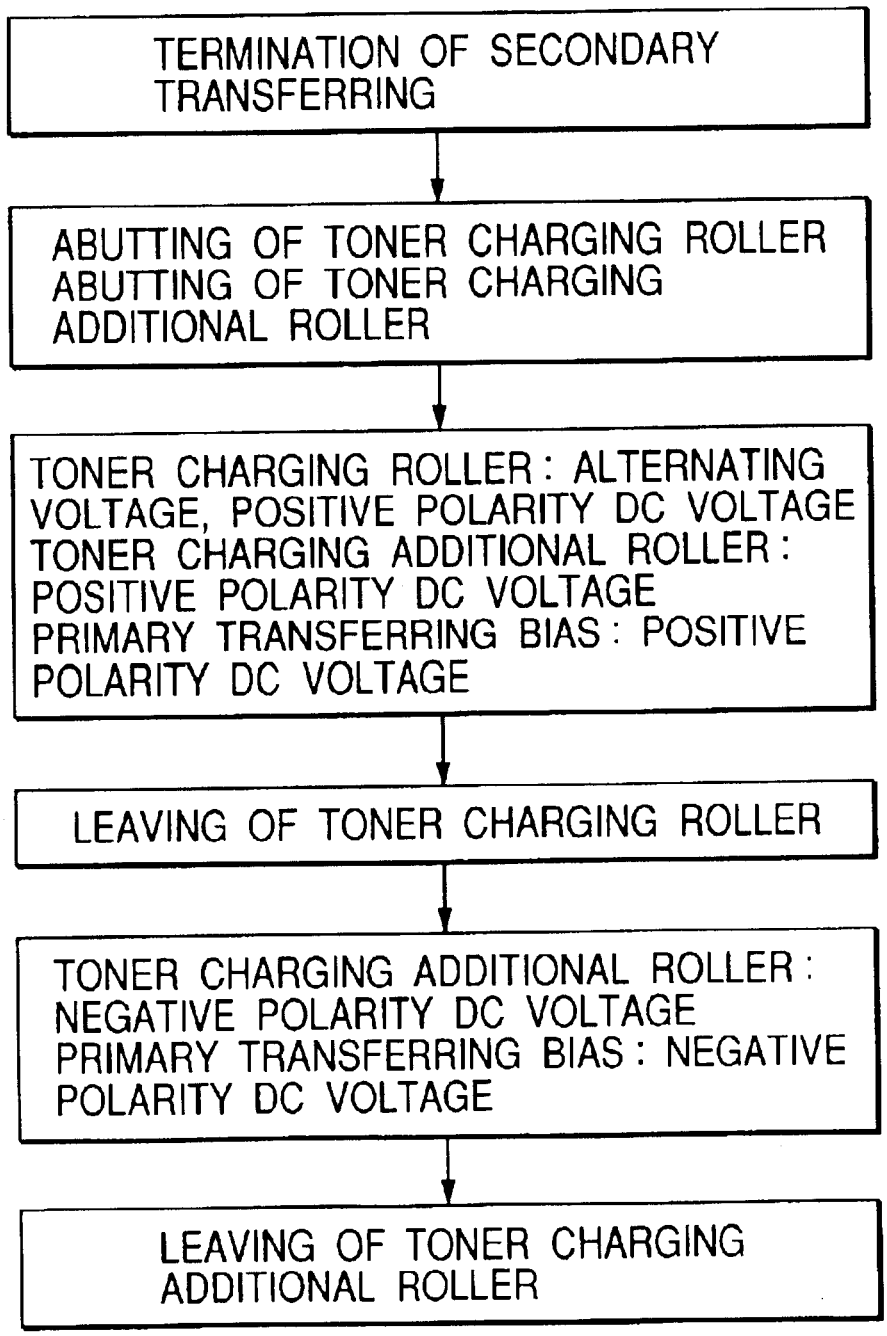
FIG. 20 is a flowchart showing removal and recovering of secondary transferring residual toner in the apparatus of FIG. 7.

Next, an embodiment of the present invention in which the discharging from an electrifying additional roller is mainly performed will be explained. FIGS. 19 and 20 are views for explaining an embodiment 5 of the present invention.

FIG. 19 shows a schematic construction of main parts of an image forming apparatus as a four-full-color laser beam printer, as an example of an image forming apparatus of the present invention.

In the image forming apparatus shown in FIG. 19, around an electro-photographic photosensitive member 1 of drum type (referred to as "photosensitive drum" hereinafter) as an image bearing member, along a rotational direction (shown by the arrow R1) thereof, in order, there are provided an electrifier 2, an exposing apparatus (exposing means) 3 for illuminating a laser beam E onto the photosensitive drum 1, a rotary developing apparatus 50, an intermediate transferring belt 109 as an intermediate transferring member and a photosensitive drum cleaner 13.

In this embodiment, the photosensitive drum 1 is a drum-shaped member rotated in the direction R1 at a surface speed of 117 mm/s and having a diameter of 46.7 mm and the surface thereof is electrified with negative polarity by the electrifier 2.

Potential (referred to as "electrified potential" hereinafter) of the surface of the photosensitive drum 1 electrified by the electrifier 2 is normally −450 V to −800 V. Further, when the photosensitive drum 1 is electrified, electrifying bias obtained by overlapping DC voltage with alternating Voltage is applied to the electrifier 2 from an electrifier power supply 17.

The electrified surface of the photosensitive drum 1 is exposed by the laser beam E from the exposing means 3 in accordance with image information, thereby forming an electrostatic latent image. Here, the exposing means 3 include a light source 3*a* such as a laser, a polygon mirror 3*b* having a six faces for performing raster scanning, a focusing lens 3*c* and a reflection mirror 3*d*.

In the rotary developing apparatus 50, four developing devices containing developers including yellow (Y) toner, magenta (M) toner, cyan (C) toner and black (K) toner and adapted to develop the electrostatic latent images formed on the photosensitive drum 1 in accordance with various color image information, i.e. an yellow developing device 5Y, a magenta developing device 5M, a cyan developing device 5C and a black developing device 5K, are mounted to a rotary 22 as a rotatable developing device support. By rotating the rotary 22 appropriately, a desired color developing device can be positioned at a developing position opposed to the photosensitive drum 1.

Further, in this embodiment, the intermediate transferring belt 109 is supported by two support shafts, i.e. a drive roller 115 and a secondary transferring counter roller 112. When the drive roller 115 rotates in a direction shown by the arrow R2, the intermediate transferring belt 109 is rotated in a direction shown by the arrow R3.

As the intermediate transferring belt 109, as an example, an endless resin belt having a thickness of about 0.05 mm to 0.3 mm in which volume resistivity thereof is adjusted to about $10^7$ to $10^{11}$ Ω·cm by carbon, ZnO, $SnO_2$, $TiO_2$ or other conductive filler can be used. In this case, as material of the resin belt, for example, PVdF (polyvinylidene fluoride), nylon, PET (polyethylene terephthalate), polycarbonate or the like can be used.

A primary transferring roller 110 as primary transferring means is disposed at a position opposed to the photosensitive drum with the interposition of the intermediate transferring belt 109, and, at this position, an abutment portion between the photosensitive drum 1 and the intermediate transferring belt 109 defines a primary transferring nip portion N1. The primary transferring roller 110 is rotatingly driven by a rotational movement of the intermediate transferring belt 109. In this embodiment, the primary transferring roller 110 has a diameter of 12 mm. Regarding the primary transferring roller 110, generally, material in which volume resistivity thereof is adjusted by adding resistance adjusting agent such as carbon to EPDM, urethane rubber, CR or NBR is used.

For example, explaining a case where a full-color image is formed, first of all, regarding a first color, yellow toner electrified with positive polarity is adhered to the electrostatic latent image formed on the photosensitive drum 1 in accordance with the image information for color-decomposed yellow color, by means of the yellow developing device 5Y mounted to the rotary 22, thereby developing the latent image as an yellow toner image.

Then, by applying primary transferring positive polarity bias to the primary transferring roller 110 from a primary transferring power supply 20, the yellow toner image formed on the photosensitive drum 1 is primarily transferred onto the intermediate transferring belt 109 at the primary transferring nip portion N1. Here, as an example, DC voltage of +500 V is used as the primary transferring bias applied to the primary transferring roller 110.

After the primary transferring, primary transferring residual toner remaining on the surface of the photosensitive drum 1 is removed by the photosensitive drum cleaner 13 including an elastic blade. Further, electricity on the photosensitive drum 1 after the primary transferring may be removed by electricity removing means such as a pre-exposure lamp.

Then, a series of image forming processes such as the above-mentioned electrifying, exposing, developing, primary transferring, cleaning and electricity removing are similarly performed with respect to image information for each of second to fourth colors. For example, by the color toners contained in the magenta developing device 5M (for second color), cyan developing device 5C (for third color) and black developing device 5K (for fourth color), the formation of the toner image on the photosensitive drum 1 is performed repeatedly, so that four color toner images are primary transferred onto the rotating intermediate transferring belt 109 in a superimposed fashion. In this embodiment, regarding all of first to fourth color toner images, the primary transferring bias of +500 V is applied to the primary transferring roller 110.

Then, by applying secondary transferring bias to a secondary transferring roller 111 as secondary transferring means rotating in a direction shown by the arrow R4 from a secondary transferring power supply 21, the toner images on the intermediate transferring belt 109 are secondarily transferred onto a surface of a recording material P collectively at a secondary transferring nip portion N2 on a secondary transferring counter roller 112. In this embodiment, the secondary transferring roller has a diameter of 20 mm. Further, here, as an example, DC voltage of +1.5 KV is used as the secondary transferring bias.

The recording material P on which four color unfixed toner images were born is conveyed to a conventional fixing apparatus (not shown), where the toner images are fixed. In this way, the image formation is completed. Thereafter, the recording material to which the image was fixed is discharged out of the apparatus.

On the other hand, after the secondary transferring is finished, by removing toner (referred to as "secondary transferring residual toner" hereinafter) not transferred to the recording material P and remaining on the intermediate transferring belt 109 from the intermediate transferring belt 109, the intermediate transferring belt 109 can be used for image formation repeatedly.

As a method for removing the secondary transferring residual toner from the intermediate transferring belt 109, there is a method in which the secondary transferring residual toner is electrified with positive polarity to be returned onto the photosensitive drum 1 and the returned toner is recovered by the photosensitive drum cleaner 13.

Namely, as shown in FIG. 19, at a position located at a downstream side of the secondary transferring nip portion N2 in a rotational direction of the intermediate transferring belt 109 and at an upstream side of the primary transferring nip portion N1, there is provided a secondary transferring residual toner electrifying roller (referred to as "toner electrifying roller" hereinafter) 23 as a first electrifying member which can be contacted with and separated from the intermediate transferring belt 109. By applying bias obtained by overlapping positive polarity DC voltage with alternating voltage to the toner electrifying roller 23 from a secondary transferring residual toner electrifying roller power supply (referred to as "toner electrifying power supply" hereinafter) 113, the secondary transferring residual toner is electrified with positive polarity. By applying the bias obtained by overlapping DC electrical field with the alternating voltage, even under an environment such as a high temperature/high humidity environment, in which it is hard to apply charges to the secondary transferring residual toner, adequate charges can be applied to the secondary transferring residual toner.

The toner electrifying roller 23 has a mechanism (not shown) for abutting the roller against the intermediate transferring belt 109 and for separating the roller from the belt, so that the roller abuts against the intermediate transferring belt 109 only when the secondary transferring residual toner is electrified. Further, a grounding counter electrode for increasing electrifying efficiency is provided on a back surface of a toner electrifying roller abutment portion N3 where the toner electrifying roller 23 abuts against the intermediate transferring belt 109. In this embodiment, the secondary transferring counter roller 112 also acts as the grounding counter electrode.

Lastly, the toner electrified with positive polarity by the toner electrifying roller 23 in this way is electrostatically transferred onto the photosensitive drum 1 at the primary transferring nip portion N1, thereby removing the secondary transferring residual toner from the intermediate transferring belt 109. Incidentally, when the secondary transferring residual toner electrified with positive polarity by the toner electrifying roller 23 is transferred onto the photosensitive drum 1, at the same time, a yellow image for the first color of a next print image can be transferred from the photosensitive drum 1 to the intermediate transferring belt 109.

As the bias applied from the toner electrifying power supply 113 to the toner electrifying roller 23, bias obtained by overlapping DC voltage of +1 KV with rectangular wave alternating voltage having frequency of 1 KHz and amplitude of 2.4 KV can be used.

Further, in order to suppress toner scattering generated when the bias obtained by overlapping the DC electrical field with the alternating voltage to the toner electrifying roller 23, the following technique is used.

That is to say, as shown in FIG. 19, a secondary transferring residual toner electrifying additional roller (referred to as "toner electrifying additional roller" hereinafter) 25 as a second electrifying member is provided between the toner electrifying roller 23 and the secondary transferring roller 111 along the intermediate transferring belt 109. DC bias is applied to the toner electrifying additional roller 25 from a secondary transferring residual toner electrifying additional roller power supply (referred to as "toner electrifying additional power supply" hereinafter) 27 so that, by such DC voltage, the secondary transferring residual toner is electrified prior to the toner electrifying roller 23. FIG. 20 shows a flowchart for explaining operations for removing and recovering the secondary transferring residual toner in an image forming apparatus including the toner electrifying additional roller 25.

As the DC voltage applied to the toner electrifying additional roller 25, as an example, voltage of +1 KV can be used. Further, the toner electrifying additional roller 25 can also be contacted with and separated from the intermediate transferring belt 109 at a toner electrifying additional roller abutment portion N4.

Now, a mechanism for scattering the secondary transferring residual toner and an operation of the toner electrifying additional roller 25 will be explained.

The secondary transferring residual toner is subjected to an electrostatic force from the electrical field created by the bias applied to the toner electrifying roller 23 in the vicinity of the toner electrifying roller 23, so that the residual toner is flying repeatedly in a gap between the toner electrifying roller 23 and the intermediate transferring belt 109. In the course of the flying, the secondary transferring residual toner is electrified with positive polarity.

However, the toner particles having particularly low charged amount among the secondary transferring residual toner particles do not reach from the intermediate transferring belt 109 to the toner electrifying roller 23 and cannot be returned to the intermediate transferring belt 109 during the repeated flying. Accordingly, the toner particles having low charged amount may be flying or be dropped by a gravity force or an air flow generated due to the rotation of the intermediate transferring belt 109, thereby causing the toner scattering.

To avoid this, the toner electrifying additional roller 25 to which the DC voltage is applied is used. Namely, the secondary transferring residual toner is electrified with positive polarity by the toner electrifying additional roller 25 before the electrifying performed by the toner electrifying roller 23. By doing so, charging amount sufficient to prevent the scattering can be applied to the toner having low charged amount and flying in the vicinity of the toner electrifying roller abutment portion N3. As a result, the toner scattering can be prevented from being generated.

By the way, after the electrifying of the secondary transferring residual toner to the positive polarity is finished, the toner electrifying roller 23 is separated from the intermediate transferring belt 109.

On the other hand, after the electrifying of the secondary transferring residual toner is finished, the negative polarity toner included in the secondary transferring residual toner is electrostatically adhered to the toner electrifying additional roller 25.

In order to remove the adhered toner, in this embodiment, before the toner electrifying additional roller 25 is separated from the intermediate transferring belt 109, bias of negative polarity DC voltage is applied to the toner electrifying additional roller 25. As the negative polarity DC voltage, as an example, voltage of −1 KV can be used.

The toner removed from the toner electrifying additional roller 25 in this way is transferred onto the intermediate transferring belt 109. When the toner transferred to the intermediate transferring belt 109 reaches the primary transferring nip portion N1, DC voltage of −1 KV is applied to the primary transferring roller 110 from the primary transferring power supply 20. As a result, the toner electrified with negative polarity and transferred from the toner electrifying additional roller 25 to the intermediate transferring belt 109 is transferred onto the photosensitive drum 1. Then, the toner is recovered by the photosensitive drum cleaner 13.

In this way, each of the toner electrifying additional power supply 27 and the primary transferring power supply 20 has a power supply for applying the DC voltage having negative or positive polarity to the toner electrifying additional roller 25 and the primary transferring roller 110, and switching means for switching the polarity of the DC voltage from positive to negative or vise versa.

In this way, the secondary transferring residual toner remaining on the intermediate transferring belt 109 is removed and is recovered by the photosensitive drum cleaner 13. According to this arrangement, the whole waste can be recovered in the photosensitive drum cleaner 13 collectively.

As such, also in this embodiment, since two electrifying rollers for electrifying the toner remaining on the intermediate transferring belt are provided, the same effect as that in the above-mentioned embodiments can be achieved.

By the way, the method for removing and recovering the secondary transferring residual toner in the above-mentioned embodiments caused the following problem.

That is to say, as the Inventors performed experiments and investigations zealously by using an image forming apparatus having the toner electrifying additional roller 25 to which the DC voltage is applied, it was found that, as the toner contained in the developing device is being deteriorated due to the continuous print, a part of the toner removed from the toner electrifying additional roller 25 may not transferred onto the photosensitive drum 1 and be remaining on the intermediate transferring belt 109 thereby to distort images printed subsequently.

Next, an embodiment of the present invention for solving the above problem will be explained.

Thus, an image forming apparatus according to an embodiment 6 of the present invention will be explained with reference to the accompanying drawings.

This embodiment is particularly characterized by a mechanism for removing and recovering the secondary transferring residual toner from the intermediate transferring belt 109. Accordingly, here, elements having constructions and functions same as those of the image forming apparatus shown in FIG. 19 are designated by the same reference numerals and detailed explanation thereof will be omitted.

Figure 21:
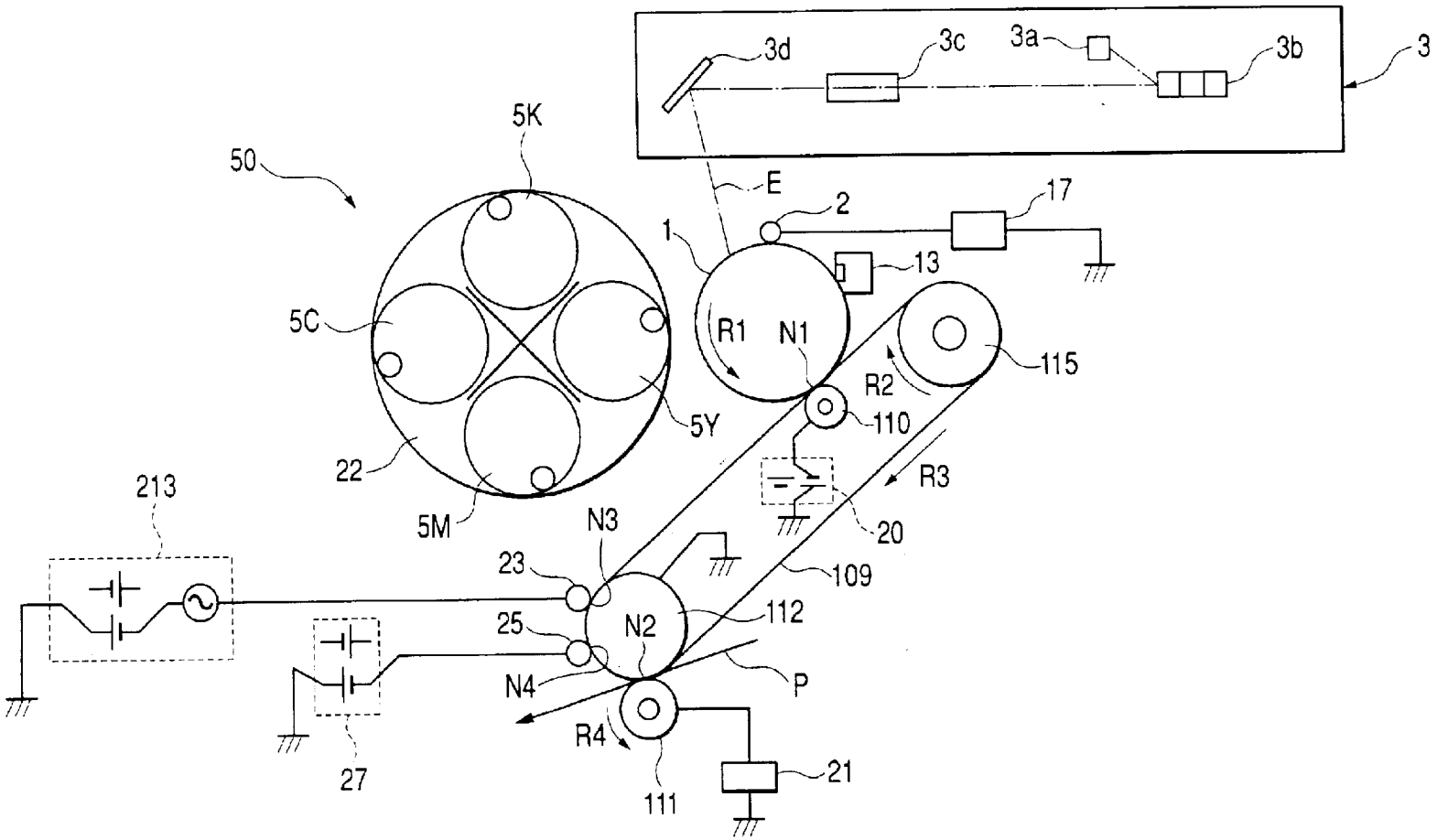
FIG. 21 is a view showing an image forming apparatus according to a still further embodiment of the present invention.

FIG. 21 shows a schematic construction of main parts of an image forming apparatus according to this embodiment. The image forming apparatus according to this embodiment includes a photosensitive drum 1 as a developer bearing member, an intermediate transferring belt 109 as an intermediate transferring member onto which a toner image formed on the photosensitive drum 1 is electrostatically transferred at a first transferring position (primary transferring nip portion) N1, a toner electrifying roller 23 as first electrifying means to which voltage obtained by overlapping DC voltage with alternating voltage is applied to electrify secondary transferring residual toner remaining on the intermediate transferring belt 109, after the toner image on the intermediate transferring belt 109 is electrostatically transferred onto a recording material P at a second transferring position (secondary transferring nip portion) N2, and a toner electrifying additional roller 24 as second electrifying means which is disposed between the second transferring position N2 and the toner electrifying roller 23 and to which DC voltage having predetermined polarity (positive polarity in this embodiment) is applied to electrify the second transferring residual toner remaining on the intermediate transferring belt 109. The secondary transferring residual toner is electrostatically transferred from the intermediate transferring belt 109 onto the photosensitive drum 1 at the first transferring position N1.

In this embodiment, when DC voltage having polarity (negative polarity in this embodiment) opposite to the above-mentioned predetermined polarity is applied to the toner electrifying additional roller 25, bias to which voltage obtained by overlapping DC voltage with alternating voltage is applied is applied to the toner electrifying roller 23. Further, in this embodiment, when the DC voltage having the polarity opposite to the predetermined polarity is applied to the toner electrifying additional roller 25, the polarity of the bias of DC voltage applied to the toner electrifying roller 23 is the same polarity as that of the DC voltage applied to the toner electrifying additional roller 25.

In this way, charges are applied to the toner transferred to the intermediate transferring belt 109 from the toner electrifying additional roller 25 by means of the toner electrifying roller 23 to which the bias obtained by overlapping the DC voltage with the alternating voltage is applied.

Figure 22:
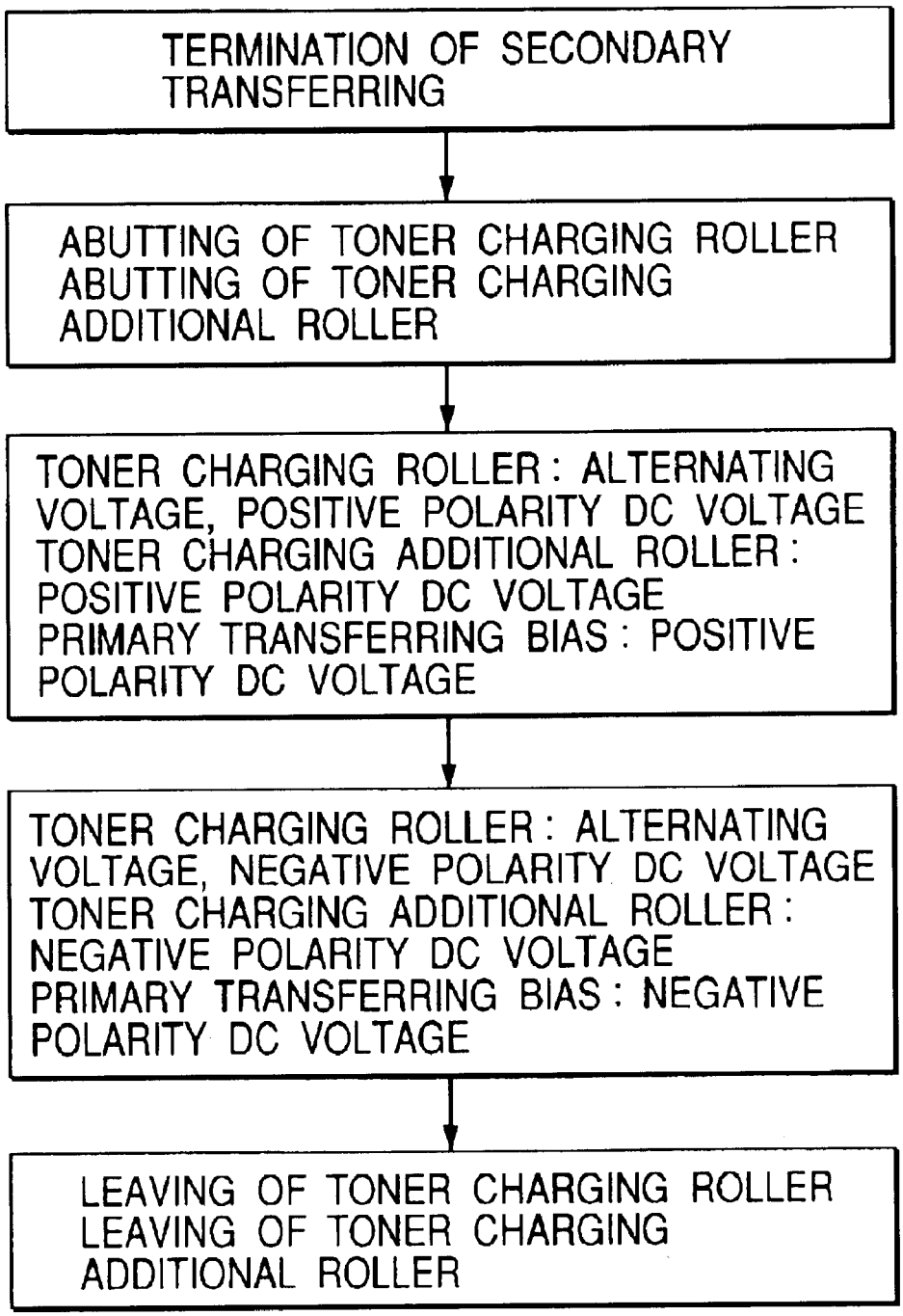
FIG. 22 is a flowchart showing removal and recovering of secondary transferring residual toner in the apparatus of FIG. 21.

Now, a method for removing and recovering the secondary transferring residual toner in this embodiment will be explained in more detail. FIG. 22 is a flowchart showing operations for removing and recovering the secondary transferring residual toner in this embodiment.

In this embodiment, as the toner electrifying roller 23, a member in which a rubber member having volume resistivity of $10^9$ Ω·cm and having a thickness of 6 mm is rolled around a metal core having a diameter of 6 mm to form a roller configuration is used.

The toner electrifying additional roller 25 is positioned between the secondary transferring nip portion N2 and the toner electrifying roller 23 and in front of the toner electrifying roller 23 in a rotational direction of the intermediate transferring belt 109. Predetermined DC voltage is applied to the toner electrifying additional roller 25 by a toner electrifying additional power supply 27.

Further, a grounding counter electrode for increasing electrifying efficiency is provided on a back surface of the intermediate transferring belt 109. In this embodiment, a secondary transferring counter roller 112 also acts as the grounding counter electrode.

As shown in FIG. 22, after the secondary transferring is finished, charges having positive polarity are applied to the secondary transferring residual toner remaining on the intermediate transferring belt 109 by the toner electrifying additional roller 25 to which DC voltage of +1 KV is applied. Then, charges having positive polarity are further applied to the secondary transferring residual toner by the toner electrifying roller 23 to which the bias obtained by overlapping the positive polarity DC voltage with the alternating voltage is applied. In this embodiment, when the secondary transferring residual toner is electrified, bias obtained by overlapping DC voltage of +1 KV with a rectangular wave having frequency of 2 KHz and amplitude of 2.4 KV is applied to the toner electrifying roller 23 from a toner electrifying power supply 213.

After the secondary transferring residual toner passes through a toner electrifying roller abutment portion N3, bias obtained by overlapping DC voltage of −1 KV with rectangular wave alternating voltage having frequency of 2 KHz and amplitude of 2.4 KV is applied to the toner electrifying roller 23 from the toner electrifying power supply 213. Further, at the same time, DC voltage of −1 KV is applied to the toner electrifying additional roller 25 from the toner electrifying additional power supply 27. In this case, charges having negative polarity are applied to the toner adhered to the toner electrifying additional roller 25 by means of the toner electrifying additional roller 25, and the toner is transferred onto the intermediate transferring belt 109. When the toner transferred to the intermediate transferring belt 109 from the toner electrifying additional roller 25 at a toner electrifying additional roller abutment portion N4 is passed through the toner electrifying roller abutment portion N3, charges having negative polarity are further applied to the toner.

In this way, in this embodiment, the toner electrifying additional power supply 27 includes a power supply capable of applying DV voltage having positive or negative polarity to the toner electrifying additional roller, and switching means for switching the DC voltage from positive to negative or vise versa. Further, in this embodiment, the toner electrifying power supply 213 also includes a power supply capable of applying DC voltage having positive or negative polarity as DC voltage to be overlapped with the alternating voltage applied to the toner electrifying roller 23, and switching means for switching DC voltage from positive to negative or vise versa.

Then, as mentioned above, after the secondary transferring residual toner electrified with positive polarity by the toner electrifying additional roller 25 and the toner electrifying roller 23 passes through the toner electrifying roller abutment portion N3, the toner reaches the primary transferring nip portion N1. The secondary transferring residual toner is electrostatically transferred onto the photosensitive drum 1 at the primary transferring nip portion N1 and is removed from the intermediate transferring belt 109. In this case, the surface of the photosensitive drum 1 is uniformly electrified to −550 V. Further, in this case, DC voltage of +500 V is applied to the primary transferring roller 110 from the primary transferring power supply 20. The secondary transferring residual toner transferred to the photosensitive drum 1 is recovered by the photosensitive drum cleaner 13. In this way, removal of the secondary transferring residual toner from the intermediate transferring belt 109 is completed.

Then, the toner transferred from the toner electrifying additional roller 25 to the intermediate transferring belt 109 and subjected to negative polarity charges by the toner electrifying roller 23 reaches the primary transferring nip portion N1. The toner transferred from the toner electrifying additional roller 25 to the intermediate transferring belt 109 is electrostatically transferred onto the photosensitive drum 1 at the primary transferring nip portion N1 and is removed from the intermediate transferring belt 109. In this case, the surface of the photosensitive drum 1 is uniformly electrified to −550 V. Further, in this case, DC voltage of −500 V is applied to the primary transferring roller 110 from the primary transferring power supply 20. The secondary transferring residual toner transferred from the toner electrifying additional roller 25 to the intermediate transferring belt 109 and transferred to the photosensitive drum 1 is recovered by the photosensitive drum cleaner 13. In this way, removal of the secondary transferring residual toner from the intermediate transferring belt 109 is completed.

In this way, in the illustrated embodiment, the primary transferring power supply 20 includes a power supply for applying DC voltage having positive or negative polarity to the primary transferring roller 110, and switching means for switching the DC voltage from positive to negative or vise versa.

In this embodiment, by electrifying the toner transferred from the toner electrifying additional roller 25 to the intermediate transferring belt 109 by the toner electrifying roller 23 to which the bias obtained by overlapping the DC voltage with the alternating voltage is applied, regardless of the deterioration of the toner contained in the developing device, the whole toner transferred from the toner electrifying additional roller 25 to the intermediate transferring belt 109 can be transferred onto the photosensitive drum 1, thereby preventing inconvenience such as distortion of the toner image printed subsequently.

Namely, according to the Inventors' investigation, cause of the fact that a part of the toner to be transferred from the toner transferring additional roller 25 to the intermediate transferring belt 109 remains on the intermediate transferring belt 109 and the action of the toner electrifying roller 23 when the charges are applied to the toner transferred from the toner transferring additional roller 25 to the intermediate transferring belt 109 by the toner electrifying roller 23 can be considered as follows:

When the negative polarity DC voltage is applied to the toner electrifying additional roller 25 to which a part of the secondary transferring residual toner was adhered, the adhered toner is transferred to the intermediate transferring belt 109 and is subjected to negative charges. However, according to the Inventors' investigation, it was found that it is hard to electrify the toner due to deterioration. Thus, in the toner electrifying additional roller 25, charges sufficient to transfer the toner onto the photosensitive drum 1 at the primary transferring nip portion N1 cannot be applied to the toner transferred from the toner electrifying additional roller 25 to the intermediate transferring belt 109. Therefore, a part of the toner remains on the intermediate transferring belt 109.

To the contrary, as is in the illustrated embodiment, by applying the charges again by means of the toner electrifying roller 23 to which the bias obtained by overlapping the DC voltage with the alternating voltage (having electrifying ability superior to the DC voltage) is applied, charges sufficient to transfer the toner onto the photosensitive drum 1 at the primary transferring nip portion N1 are applied to the toner transferred from the toner electrifying additional roller 25 to the intermediate transferring belt 109. Accordingly, it is possible to prevent the toner from remaining on the intermediate transferring belt 109.

In the illustrated embodiment, abutment/separation control for the toner electrifying roller 23 and the toner electrifying additional roller 25, control of switching of polarity of various applied biases and control of timings for applying various biases are performed by a control circuit as control means for managing and controlling the operation of the image forming apparatus.

As mentioned above, according to this embodiment, by applying the charges to the toner transferred from the toner electrifying additional roller 25 to the intermediate transferring belt 109 by means of the toner electrifying roller 23 to which the bias obtained by overlapping the DC voltage with the alternating voltage is applied, the whole toner transferred from the toner electrifying additional roller 25 to the intermediate transferring belt 109 can be transferred onto the photosensitive drum 1. Accordingly, regardless of the deterioration contained in the developing device, inconvenience that the toner transferred from the toner electrifying additional roller 25 to the intermediate transferring belt 109 is not transferred onto the photosensitive drum 1 and is remaining on the intermediate transferring belt 109 thereby to distort the subsequently formed image can be avoided.

Next, an embodiment 7 of the present invention will be explained.

Figure 23:
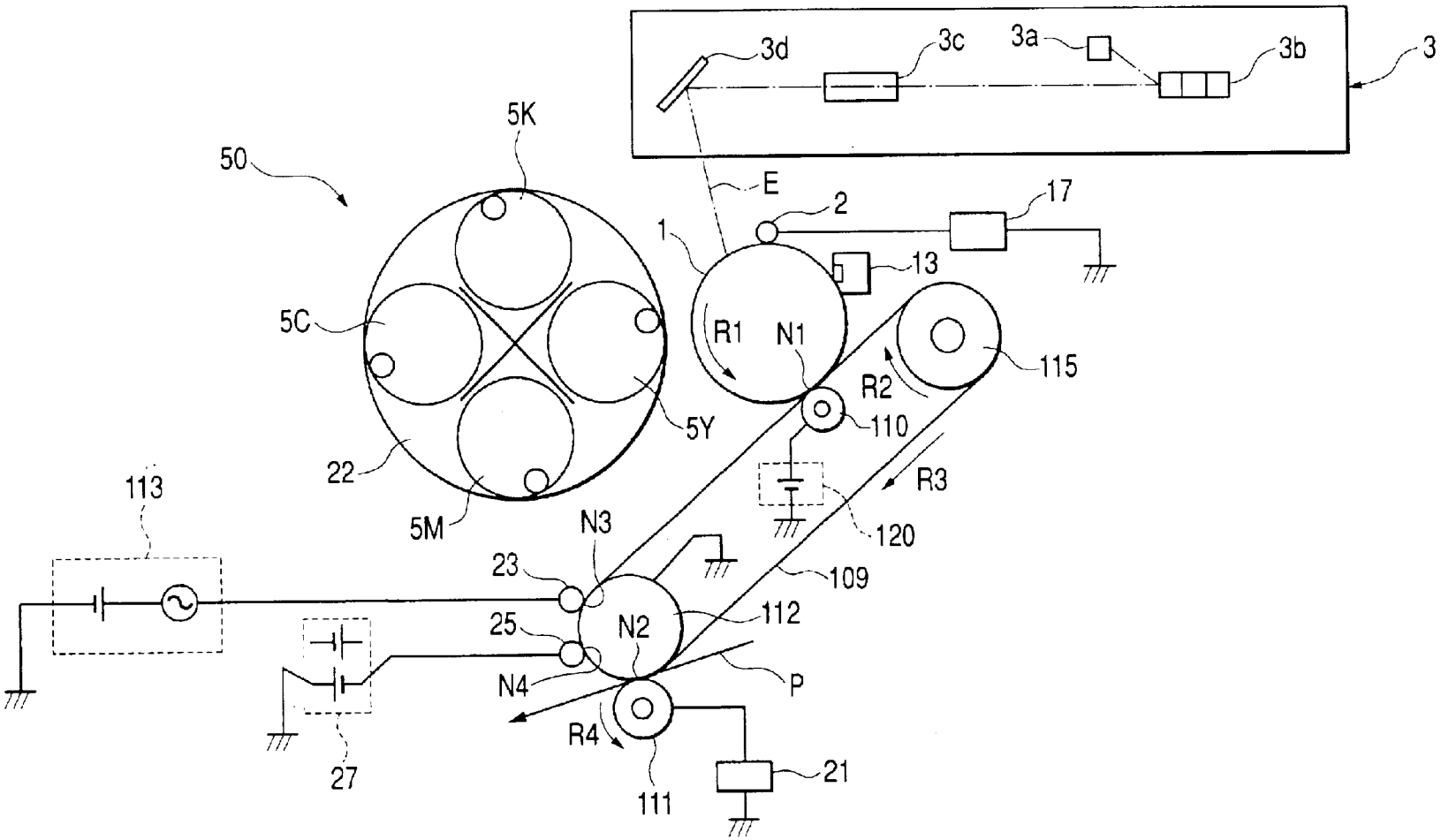
FIG. 23 is a view showing an image forming apparatus according to a further embodiment of the present invention.

FIG. 23 shows a schematic construction of main parts of an image forming apparatus according to the embodiment 7. Similar to the embodiment 6, the image forming apparatus according to this embodiment is designed so that the charges are applied to the toner transferred from the toner electrifying additional roller 25 to the intermediate transferring belt 109 by means of the toner electrifying roller 23 to which the bias obtained by overlapping the DC voltage with the alternating voltage is applied.

In this embodiment, when the DC voltage having polarity (negative polarity in this embodiment) opposite to the predetermined polarity upon electrifying the secondary transferring residual toner on the intermediate transferring belt 109 is applied to the toner electrifying additional roller 25, the polarity of DC voltage of the bias applied to the toner electrifying roller 23 is made to be opposite (positive polarity in this embodiment) to that of the DC voltage applied to the toner electrifying additional roller 25.

Figure 24:
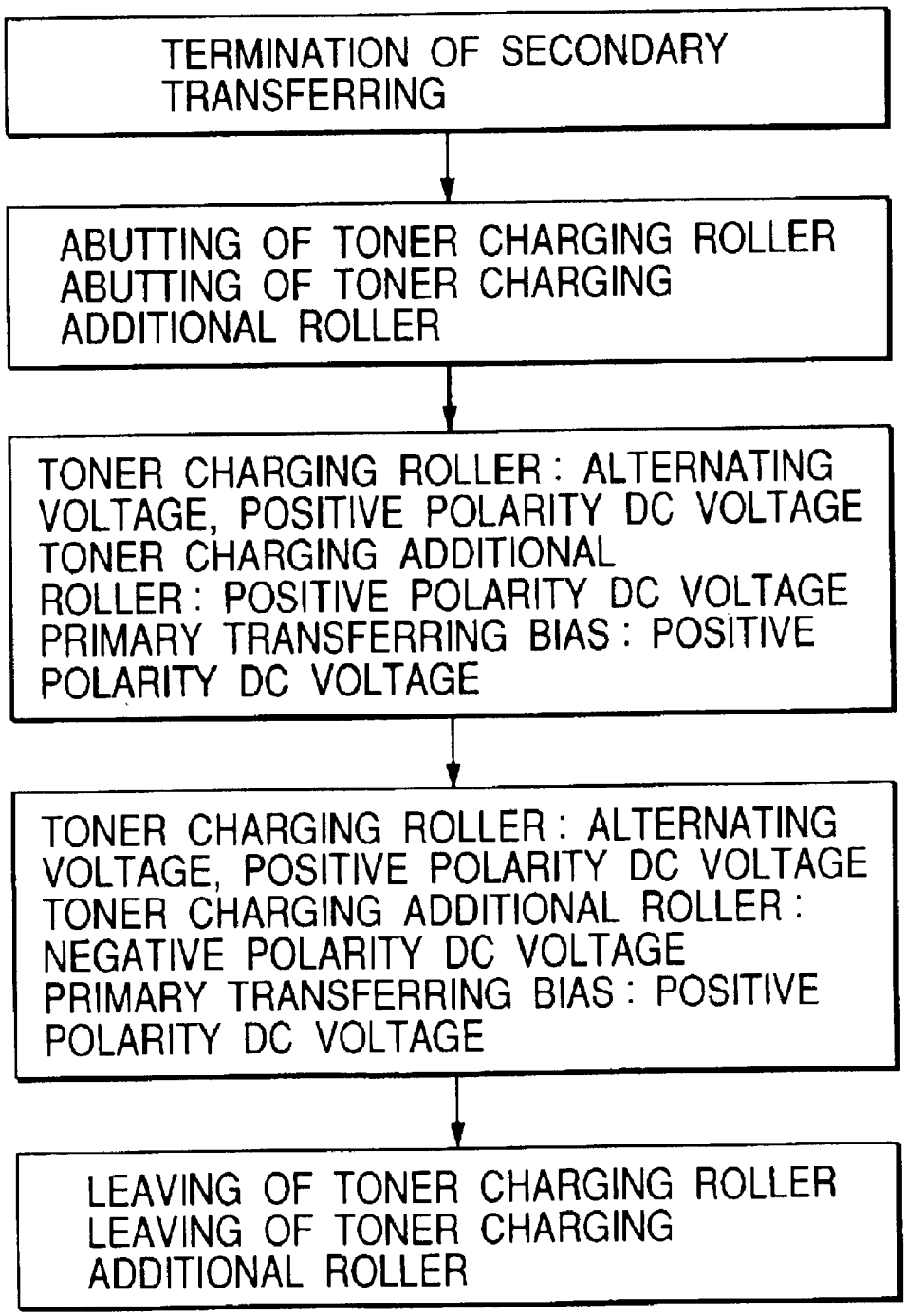
FIG. 24 is a flowchart showing removal and recovering of secondary transferring residual toner in the apparatus of FIG. 23.

Now, a method for removing and recovering the secondary transferring residual toner in this embodiment will be explained in more detail. FIG. 24 is a flowchart showing operations for removing and recovering the secondary transferring residual toner in this embodiment.

As shown in FIG. 24, in this embodiment, similar to the embodiment 6, DC voltage of −1 KV is applied to the secondary transferring residual toner electrifying additional roller to transfer the toner adhered to the toner electrifying additional roller 25 onto the intermediate transferring belt 109. The toner transferred to the intermediate transferring belt 109 is electrified with positive polarity by the toner electrifying roller 23 to which bias obtained by overlapping positive polarity DC voltage (+1 KV) with alternating voltage (frequency of 1 KHz and amplitude of 2.4 KV) is applied. When the toner on the intermediate transferring belt 109 reaches the primary transferring nip portion N1, positive polarity DC voltage (+500 V) is applied to the primary transferring roller 110 from the primary transferring power supply 120. Then, the toner on the intermediate transferring belt 109 is transferred onto the photosensitive drum 1 and then is recovered by the photosensitive drum cleaner 13.

As is in this embodiment, even when the toner transferred from the toner electrifying additional roller 25 to the intermediate transferring belt 109 is electrified with positive polarity by the toner electrifying roller 23, by applying the bias obtained by overlapping the DC voltage with the alternating voltage to the toner electrifying roller 23 to apply the adequate charged amount to the toner, regardless of the deterioration of the toner contained in the developing device, the whole toner on the intermediate transferring belt 109 can be transferred onto the photosensitive drum 1, thereby preventing the distortion of images printed subsequently.

Further, in this embodiment, when the toner transferred from the toner electrifying additional roller 25 to the intermediate transferring belt 109 is further transferred onto the photosensitive drum 1, since the positive polarity DC voltage is applied to the primary transferring roller 110, a power supply for applying negative polarity DC voltage is not required, with the result that the construction of the primary transferring power supply 120 can be simplified.

By the way, in this case, since the toner transferred from the toner electrifying additional roller 25 to the intermediate transferring belt 109 has the negative polarity, there is the risk that the toner is electrostatically adhered to the toner electrifying roller 23. However, since the toner performs a reciprocal movement in the gap between the toner electrifying roller 23 and the intermediate transferring belt 109 by the action of the alternating voltage applied to the toner electrifying roller 23, the toner is not adhered to the toner electrifying roller 23.

As mentioned above, according to this embodiment, regardless of the deterioration of the toner contained in the developing device, inconvenience that the toner transferred from the toner electrifying additional roller 25 to the intermediate transferring belt 109 is not transferred onto the photosensitive drum 1 and is remaining on the intermediate transferring belt 109 thereby to distort the images formed subsequently can be prevented.

Next, an embodiment 8 of the present invention will be explained.

Figure 25:
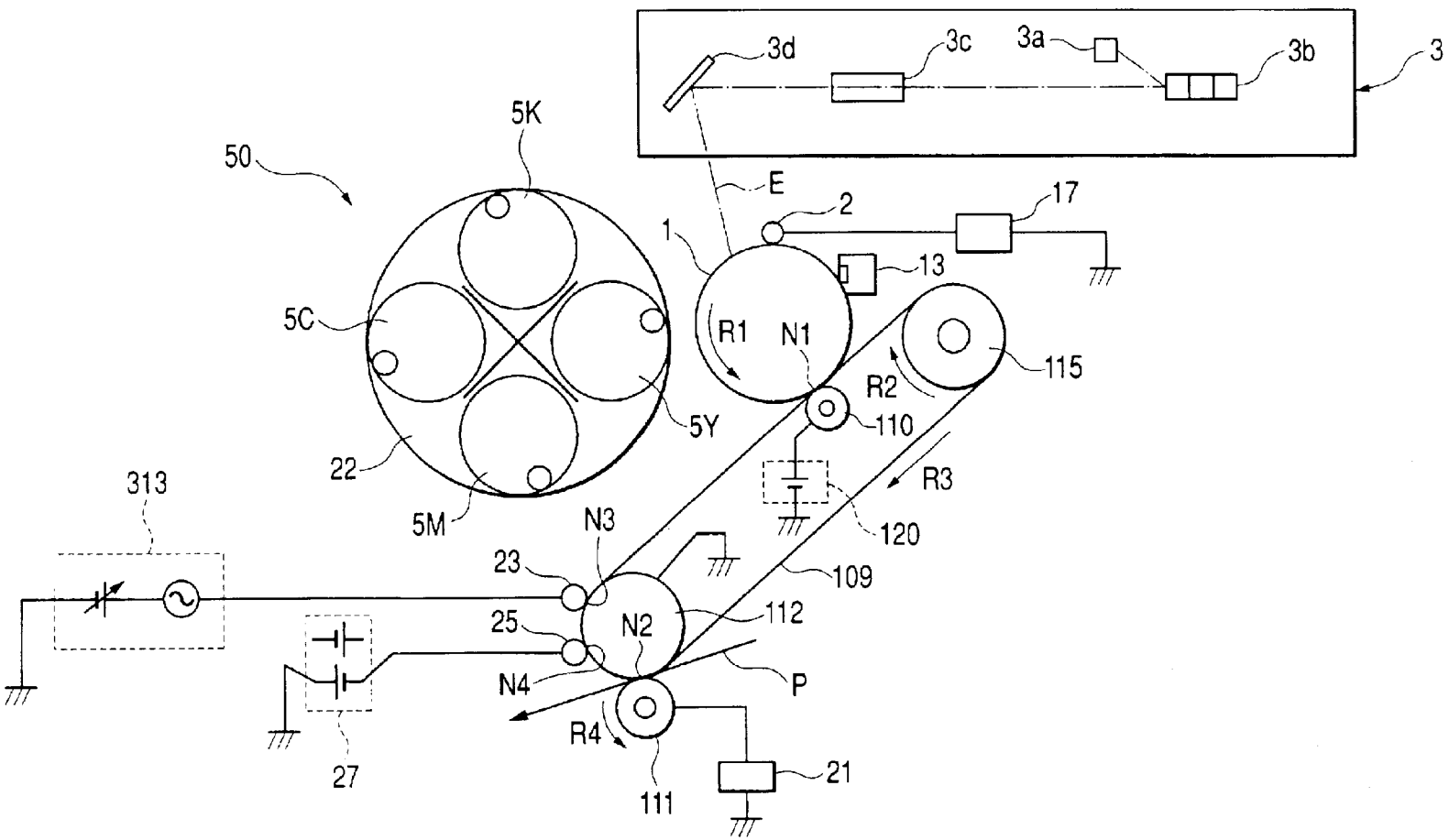
FIG. 25 is a view showing an image forming apparatus according to a still further embodiment of the present invention.

FIG. 25 shows a schematic construction of main parts of an image forming apparatus according to this embodiment. Similar to the embodiments 6 and 7, the image forming apparatus according to this embodiment is designed so that the charges are applied to the toner transferred from the toner electrifying additional roller 25 to the intermediate transferring belt 109 by means of the toner electrifying roller 23 to which the bias obtained by overlapping the DC voltage with the alternating voltage is applied from a power supply 313.

In this embodiment, primary transferring of the toner image from the photosensitive drum 1 onto the intermediate transferring belt 109 and cleaning of the secondary transferring residual toner on the intermediate transferring belt 109 are performed simultaneously. In this case, when the DC voltage having polarity (negative polarity in this embodiment) opposite to the predetermined polarity upon electrifying the secondary transferring residual toner on the intermediate transferring belt 109 is applied to the toner electrifying additional roller 25, the toner electrifying additional roller 25 is contacted with a non-image area of the intermediate transferring belt 109.

Figure 26:
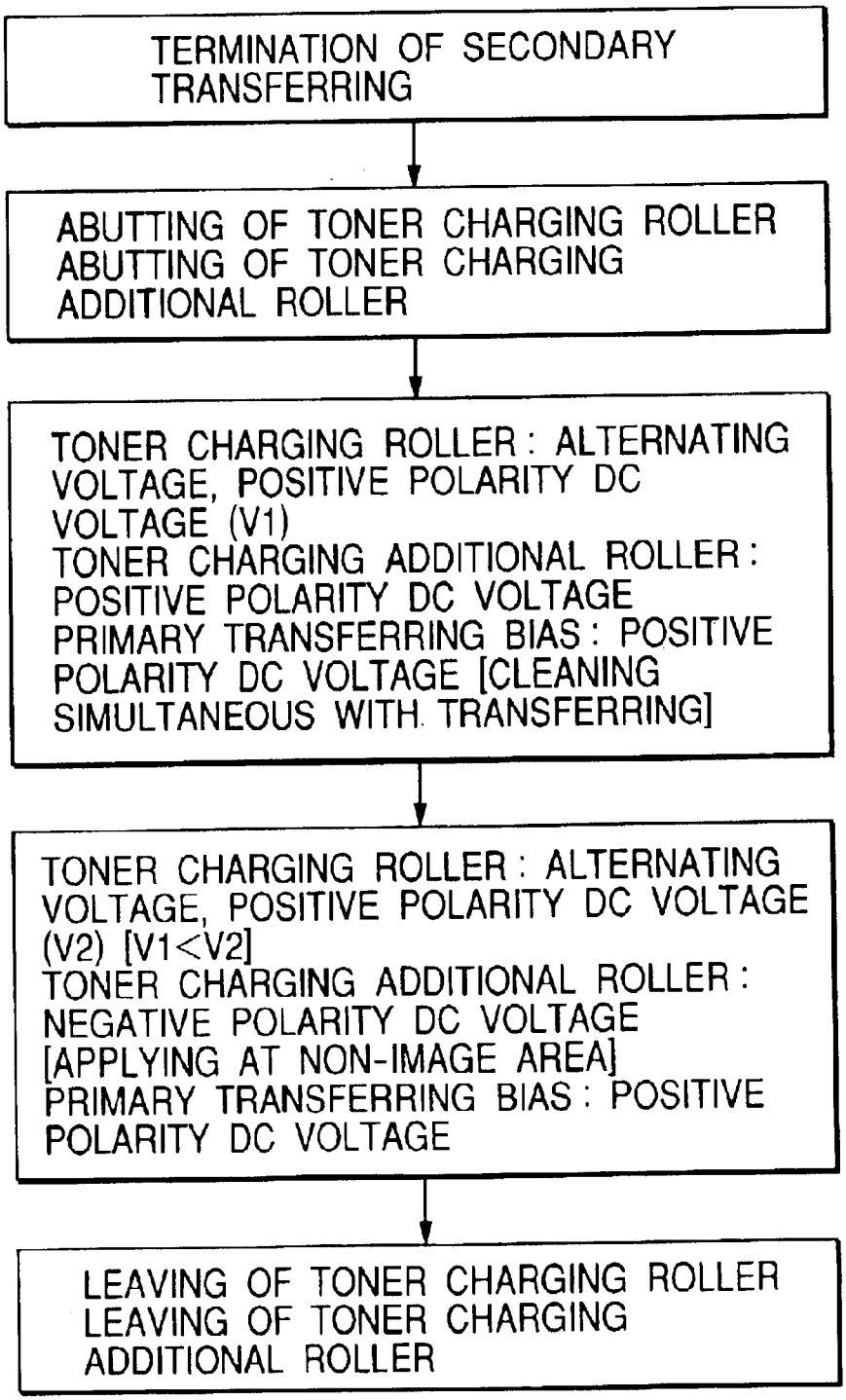
FIG. 26 is a flowchart showing removal and recovering of secondary transferring residual toner in the apparatus of FIG. 25.

Now, a method for removing and recovering the secondary transferring residual toner in this embodiment will be explained in more detail. FIG. 26 is a flowchart showing operations for removing and recovering the secondary transferring residual toner in this embodiment.

In this embodiment, when the secondary transferring residual toner electrified with positive polarity by means of the toner electrifying roller 23 to which the bias obtained by overlapping the positive polarity DC voltage with the alternating voltage is applied and the toner electrifying additional roller 25 to which the positive polarity DC voltage is applied is transferred from the intermediate transferring belt 109 onto the photosensitive drum 1, at the same time, a first color yellow image of a next print image is transferred from the photosensitive drum 1 onto the intermediate transferring belt 109 (hereinafter, this process is called as "cleaning simultaneous with transferring").

In this case, as shown in FIG. 26, in this embodiment, bias obtained by overlapping DC voltage of +800 V with a rectangular wave having frequency of 1 KHz and amplitude of 2.4 KV is applied to the toner electrifying roller 23, and DC voltage of +1 KV is applied to the toner electrifying additional roller 25.

Further, similar to the embodiment 5, the toner adhered to the toner electrifying additional roller 25 is transferred onto the intermediate transferring belt 109 by applying DC (−1 KV) voltage to the toner electrifying additional roller 25. Here, the toner adhered to the toner electrifying additional roller 25 is transferred onto a so-called non-image area of the intermediate transferring belt 109 which is not used for the printing of the next image.

Then, the toner transferred from the toner electrifying additional roller 25 to the intermediate transferring belt 109 is electrified with positive polarity by the toner electrifying roller 23 to which bias obtained by overlapping positive polarity DC voltage (+1 KV) with alternating voltage (having frequency of 1 KHz and amplitude of 2.4 KV) is applied. Then, after the toner electrified with positive polarity is transferred onto the photosensitive drum 1 at the primary transferring nip portion N1, the toner is recovered by the photosensitive drum cleaner 13.

In this embodiment, DC voltage V2 (+1 KV) of the bias applied to the toner electrifying roller 23 when the toner transferred from the toner electrifying additional roller 25 to the intermediate transferring belt 109 is electrified with positive polarity by the toner electrifying roller 23 is greater than DC voltage V1 (+800 V) of the bias applied when the secondary transferring residual toner is electrified with positive polarity.

With the above-mentioned arrangement, when the cleaning simultaneous with transferring is performed, the secondary transferring residual toner on the intermediate transferring belt 109 and the toner transferred from the toner electrifying additional roller 25 to the intermediate transferring belt 109 can be transferred onto the photosensitive drum 1 properly. Namely, in the case where the cleaning simultaneous with transferring is performed, when the toner transferred from the toner electrifying additional roller 25 to the intermediate transferring belt 109 is electrified, it is required that the DC voltage V2 of the bias applied to the toner electrifying roller 23 is made to be greater than the DC voltage V1 of the bias applied when the secondary transferring residual toner on the intermediate transferring belt 109 is electrified with positive polarity and that the toner adhered to the toner electrifying additional roller 25 is transferred onto the non-image area of the intermediate transferring belt 109. The reason is as follows.

If the DC voltage of the bias to be applied to the toner electrifying roller 23 is set to be higher to apply more charges to the toner, the toner on the intermediate transferring belt 109 is transferred onto the photosensitive drum 1 more easily. However, when the cleaning simultaneous with transferring is performed, if excessive charges are applied to the secondary transferring residual toner, a part of the toner image borne on the photosensitive drum 1 is not transferred onto the intermediate transferring belt 109, thereby causing lacking in image.

On the other hand, under a low temperature/low humidity environment and the like, if the resistance of the recording material P is increased so that adequate electrical current does not flow from the secondary transferring roller 111 to the recording material P, an amount of the negative polarity toner included in the secondary transferring residual toner is increased, with the result that, when the positive polarity DC voltage is applied, an amount of the toner adhered to the secondary transferring residual toner electrifying additional roller 25 is increased.

In this case, an amount, pr unit area on the intermediate transferring belt 109, of the negative polarity toner transferred from the toner electrifying additional roller 25 to the intermediate transferring belt 109 may be considerably greater than an amount, pr unit area on the intermediate transferring belt 109, of the positive polarity secondary transferring residual toner. In order to transfer the whole negative polarity toner transferred from the toner electrifying additional roller 25 to the intermediate transferring belt 109 onto the photosensitive drum 1, it is required that DC voltage of the bias applied to the toner electrifying roller 23 when such toner is electrified be greater than positive polarity DC voltage of the bias applied to the toner electrifying roller 23 when the secondary transferring residual toner on the intermediate transferring belt 109 is firstly electrified with positive polarity.

Under such a condition, when the secondary transferring residual toner on the intermediate transferring belt 109 is firstly electrified with positive polarity, if the bias (i.e. bias having high DC voltage) when the toner transferred from the toner electrifying additional roller 25 to the intermediate transferring belt 109 is electrified is applied to the toner electrifying roller 23, lacking in image will occur.

Thus, it is necessary that the DC voltage V2 of the bias applied to the toner electrifying roller 23 when the toner transferred from the toner electrifying additional roller 25 to the intermediate transferring belt 109 is electrified with positive polarity be greater than the DC voltage V1 of the bias applied when the secondary transferring residual toner is electrified with positive polarity.

Further, since the bias obtained by overlapping high DC voltage with the alternating voltage is applied to the toner transferred from the toner electrifying additional roller 25 to the intermediate transferring belt 109 from the toner electrifying roller 23, a part of the toner is electrified excessively. Accordingly, if the toner adhered to the toner electrifying additional roller 25 is transferred onto a portion of the intermediate transferring belt 109 which is used for the next print and the cleaning simultaneous with transferring is performed, the lacking in image will occur. Thus, the toner adhered to the toner electrifying additional roller 25 must be transferred onto the non-image area of the intermediate transferring belt 109.

As mentioned above, according to this embodiment, also in the image forming apparatus in which the cleaning simultaneous with transferring is performed, by applying charges having positive polarity to the toner transferred from the toner electrifying additional roller 25 to the intermediate transferring belt 109 by means of the toner electrifying roller 23 to which the bias obtained by overlapping the DC voltage with the alternating voltage is applied, the whole toner can be transferred onto the photosensitive drum 1, thereby preventing the inconvenience that the images printed subsequently are distorted. Further, in this embodiment, by transferring the toner adhered to the toner electrifying additional roller 25 onto the non-image area of the intermediate transferring belt 109, the lacking in image can also be prevented.

Incidentally, in the illustrated embodiment, while an example that the belt-shaped member is used as the intermediate transferring member was explained, the configuration of the intermediate transferring member is not limited to the belt, but, even when a drum-shaped member is used, the similar technical effect can be achieved.

Further, in the above-mentioned embodiments, while an example that the developer mainly includes negative polarity toner was explained, the present invention is not limited to such an example. When the developer mainly includes positive polarity toner, essentially, in the above-mentioned embodiments, the polarity of the DC voltages applied at each stage to the toner electrifying roller 23, toner electrifying additional roller 25 and primary transferring roller 110 may be opposite polarity. It is appreciated for the skilled in the art that, even when toner having either polarity is used, the present invention can easily be adapted from the explanation of the above-mentioned embodiments.

In this way, according to the above-mentioned embodiments, regardless of the deterioration of the toner contained in the developing device, the inconvenience that the developer transferred from the second electrifying means to the intermediate transferring member is not transferred later to be remained on the intermediate transferring member thereby to cause distortion of the images formed subsequently can be avoided.

While the present invention was explained in connection with preferred embodiments thereof, the present invention is not limited to such embodiments, and various alterations can be made within the scope of the invention.

What is claimed is:

1. An image forming apparatus comprising:

a first image bearing member;

a movable, second image bearing member;

first transferring means for transferring a toner image on said first image bearing member to said second image bearing member at a first transferring portion;

second transferring means for transferring the toner image on said second image bearing member to a transferring material at a second transferring portion;

a first charging member provided at a downstream side of said second transferring portion and at an upstream side of said first transferring portion in a moving direction of said second image bearing member;

a second charging member provided at the downstream side of said second transferring portion and at an upstream side of said first charging member in the moving direction of said second image bearing member; and voltage applying means for applying voltage to said first and second charging members, wherein said voltage applying means applies the voltage to said first and second charging members to transfer toner adhered to said first and second charging members onto said second image bearing member.

2. An image forming apparatus according to claim 1, wherein voltage applying means applies the voltage to said first and second charging members in order to apply charges having a polarity opposite to a normal polarity to the toner remaining on said second image bearing member and passed through said second transferring portion.

3. An image forming apparatus according to claim 2, wherein said voltage applying means includes switching means for switching between a first mode for applying charges having the polarity opposite to the normal polarity to the toner remaining on said second image bearing member and passed through said second transferring portion and a second mode for transferring the toner adhered to said first and second charging member to said second image bearing member.

4. An image forming apparatus according to claim 1, further comprising cleaning means for recovering the toner on said first image bearing member, wherein the toner on said second image bearing member is transferred to said first image bearing member at said first transferring portion and then is recovered by said cleaning means.

5. An image forming apparatus according to claim 1, wherein said voltage applying means includes first voltage applying means for applying voltage to said first charging member and second voltage applying means for applying voltage to said second charging member, and wherein said first and second voltage applying means can apply the voltages independently from each other.

6. An image forming apparatus according to claim 5, wherein said first voltage applying means is a DC voltage power supply.

7. An image forming apparatus according to claim 5, wherein said first voltage applying means is an alternating voltage power supply for overlapping a DC voltage with an alternating voltage.

8. An image forming apparatus according to claim 5, wherein said second voltage applying means is a DC voltage power supply.

9. An image forming apparatus according to claim 1, wherein, when images are formed on a plurality of recording materials continuously, at a timing between an image forming process and an image forming process among a plurality of image forming processes corresponding to the respective recording materials, the toner adhered to said first and second charging members is transferred to said second image bearing member.

10. An image forming apparatus according to claim 1, wherein a plurality of different color toner images are formed on said second image bearing member in a laminated fashion, and, at a timing between an image forming process and an image forming process among a plurality of image forming processes corresponding to the respective plural color images, the toner adhered to said first and second charging members is transferred to said second image bearing member.

11. An image forming apparatus according to claim 1, wherein the toner adhered to said first and second charging members is transferred onto said second image bearing member during a post-rotation process of said image forming process.

12. An image forming apparatus according to claim 1, wherein said second image bearing member and said first charging member are rotary members, respectively, and a difference obtained by subtracting a maximum image length from a circumferential length of said second image bearing member is greater than a circumferential length of said first charging member so that the toner adhered to said first charging member is transferred to a non-image portion of said second image bearing member through a time period greater than a rotational period of said first charging member.

13. An image forming apparatus according to claim 1, wherein said second image bearing member and said second charging member are rotary members, respectively, and a difference obtained by subtracting a maximum image length from a circumferential length of said second image bearing member is greater than a circumferential length of said second charging member so that the toner adhered to said second charging member is transferred to a non-image portion of said second image bearing member through a time period greater than a rotational period of said second charging member.

14. An image forming apparatus comprising:

a first image bearing member;

a movable, second image bearing member;

first transferring means for transferring a toner image on said first image bearing member to said second image bearing member at a first transferring portion;

second transferring means for transferring the toner image on said second image bearing member to a transferring material at a second transferring portion;

a first charging member provided at a downstream side of said second transferring portion and at an upstream side of said first transferring portion in a moving direction of said second image bearing member;

a second charging member provided at the downstream side of said second transferring portion and at an upstream side of said first charging member in the moving direction of said second image bearing member; and voltage applying means for applying voltage to said first and second charging members, wherein said voltage applying means applies the voltage to said second charging member to transfer toner adhered to said second charging member onto said second image bearing member.

15. An image forming apparatus according to claim 14, wherein said voltage applying means applies the voltage to said first charging member in order to charge the toner transferred from said second charging member to said second image bearing member.

16. An image forming apparatus according to claim 14, wherein voltage applying means applies the voltage to said first and second charging members in order to apply charges having a polarity opposite to a normal polarity to the toner remaining on said second image bearing member and passed through said second transferring portion.

17. An image forming apparatus according to claim 16, wherein said voltage applying means includes switching means for switching between a first mode for applying charges having the polarity opposite to the normal polarity to the toner remaining on said second image bearing member and passed through said second transferring portion and a second mode for transferring the toner adhered to said second charging member to said second image bearing member.

18. An image forming apparatus according to claim 14, further comprising cleaning means for recovering the toner on said first image bearing member, wherein the toner on said second image bearing member is transferred to said first image bearing member at said first transferring portion and then is recovered by said cleaning means.

19. An image forming apparatus according to claim 14, wherein said voltage applying means includes first voltage applying means for applying voltage to said first charging member and second voltage applying means for applying voltage to said second charging member, and wherein said first and second voltage applying means can apply the voltages independently from each other.

20. An image forming apparatus according to claim 19, wherein said first voltage applying means is a DC voltage power supply.

21. An image forming apparatus according to claim 19, wherein said first voltage applying means is an alternating voltage power supply for overlapping a DC voltage with an alternating voltage.

22. An image forming apparatus according to claim 21, wherein the DC voltage of said first voltage applying means is variable.

23. An image forming apparatus according to claim 19, wherein said second voltage applying means is a DC voltage power supply.

24. An image forming apparatus according to claim 14, wherein, when images are formed on a plurality of recording materials continuously, at a timing between an image forming process and an image forming process among a plurality of image forming processes corresponding to the respective recording materials, the toner adhered to said second charging member is transferred to said second image bearing member.

25. An image forming apparatus according to claim 14, wherein a plurality of different color toner images are formed said second image bearing member in a laminated fashion, and, at a timing between an image forming process and an image forming process among a plurality of image forming processes corresponding to the respective plural color images, the toner adhered to said second charging member is transferred to said second image bearing member.

26. An image forming apparatus according to claim 14, wherein the toner adhered to said second charging member is transferred onto said second image bearing member during a post-rotation process of an image forming process.

27. An image forming apparatus according to claim 14, wherein said second image bearing member and said second charging member are rotary members, respectively, and a difference obtained by subtracting a maximum image length from a circumferential length of said second image bearing member is greater than a circumferential length of said second charging member so that the toner adhered to said second charging member is transferred to a non-image portion of said second image bearing member through a time period greater than a rotational period of said second charging member.

28. An image forming apparatus comprising:

a first image bearing member;

a movable, second image bearing member;

first transferring means for transferring a toner image on said first image bearing member to said second image bearing member at a first transferring portion;

second transferring means for transferring the toner image on said second image bearing member to a transferring material at a second transferring portion;

a first charging member provided at a downstream side of said second transferring portion and at an upstream side of said first transferring portion in a moving direction of said second image bearing member;

a second charging member provided at the downstream side of said second transferring portion and at an upstream side of said first charging member in the moving direction of said second image bearing member; and voltage applying means for applying voltage to said first and second charging members;

wherein said voltage applying means applies the voltage to said first charging member to transfer toner adhered to said first charging member onto said second image bearing member.

29. An image forming apparatus according to claim 28, wherein voltage applying means applies the voltage to said first and second charging members in order to apply charges having a polarity opposite to a normal polarity to the toner remaining on said second image bearing member and passed through said second transferring portion.

30. An image forming apparatus according to claim 29, wherein said voltage applying means includes switching means for switching between a first mode for applying charges having the polarity opposite to the normal polarity to the toner remaining on said second image bearing member and passed through said second transferring portion and a second mode for transferring the toner adhered to said first charging member to said second image bearing member.

31. An image forming apparatus according to claim 28, further comprising cleaning means for recovering the toner on said first image bearing member, wherein the toner on said second image bearing member is transferred to said first image bearing member at said first transferring portion and then is recovered by said cleaning means.

32. An image forming apparatus according to claim 28, wherein said voltage applying means includes first voltage applying means for applying voltage to said first charging member and second voltage applying means for applying voltage to said second charging member, wherein said first and second voltage applying means can apply the voltages independently from each other.

33. An image forming apparatus according to claim 32, wherein said first voltage applying means is a DC voltage power supply.

34. An image forming apparatus according to claim 32, wherein said first voltage applying means is an alternating voltage power supply for overlapping a DC voltage with an alternating voltage.

35. An image forming apparatus according to claim 32, wherein said second voltage applying means is a DC voltage power supply.

36. An image forming apparatus according to claim 28, wherein, when images are formed on a plurality of recording materials continuously, at a timing between an image forming process and an image forming process among a plurality of image forming processes corresponding to the respective recording materials, the toner adhered to said first charging member is transferred to said second image bearing member.

37. An image forming apparatus according to claim 28, wherein a plurality of different color toner images are formed said second image bearing member in a laminated fashion, and, at a timing between an image forming process and an image forming process among a plurality of image forming processes corresponding to the respective plural color images, the toner adhered to said first charging member is transferred to said second image bearing member.

38. An image forming apparatus according to claim 28, wherein the toner adhered to said first charging member is transferred onto said second image bearing member during a post-rotation process of an image forming process.

39. An image forming apparatus according to claim 28, wherein said second image bearing member and said first charging member are rotary members, respectively, and a difference obtained by subtracting a maximum image length from a circumferential length of said second image bearing member is greater than a circumferential length of said first charging member so that the toner adhered to said first charging member is transferred to a non-image portion of said second image bearing member through a time period greater than a rotational period of said first charging member.

* * * * *

UNITED STATES PATENT AND TRADEMARK OFFICE

CERTIFICATE OF CORRECTION

PATENT NO. : 6,879,801 B2
DATED : April 12, 2005
INVENTOR(S) : Takamitsu Soda et al.

It is certified that error appears in the above-identified patent and that said Letters Patent is hereby corrected as shown below:

Column 11,
Line 61, “rollers’” should read -- rollers --.

Column 15,
Line 41, “To” should read -- to --.

Column 16,
Line 57, “executing” should read -- execute --.

Column 22,
Line 38, “method” should read -- method, --; and
Line 39, “and” should be deleted.

Column 26,
Line 29, “born” should read -- borne --.

Column 29,
Line 5, “transferred” should read -- be transferred --.

Column 35,
Lines 30 and 34, “pr” should read -- per --.

Column 39,
Line 40, “formed” should read -- formed on --.

UNITED STATES PATENT AND TRADEMARK OFFICE

CERTIFICATE OF CORRECTION

PATENT NO. : 6,879,801 B2
DATED : April 12, 2005
INVENTOR(S) : Takamitsu Soda et al.

It is certified that error appears in the above-identified patent and that said Letters Patent is hereby corrected as shown below:

Column 40,
Line 67, "formed" should read -- formed on --.

Signed and Sealed this

Thirteenth Day of September, 2005

JON W. DUDAS
*Director of the United States Patent and Trademark Office*